US009532408B2

(12) United States Patent
Asami et al.

(10) Patent No.: US 9,532,408 B2
(45) Date of Patent: Dec. 27, 2016

(54) HEATING COOKER

(75) Inventors: Shinji Asami, Osaka (JP); Hiroyuki Katoh, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 795 days.

(21) Appl. No.: 13/819,642

(22) PCT Filed: Aug. 29, 2011

(86) PCT No.: PCT/JP2011/069394

§ 371 (c)(1),
(2), (4) Date: Feb. 27, 2013

(87) PCT Pub. No.: WO2012/029691

PCT Pub. Date: Mar. 8, 2012

(65) Prior Publication Data

US 2013/0153571 A1 Jun. 20, 2013

(30) Foreign Application Priority Data

Aug. 31, 2010 (JP) ..... 2010-193612

(51) Int. Cl.
*H05B 6/64* (2006.01)
*H05B 6/62* (2006.01)
(Continued)

(52) U.S. Cl.
CPC ..... *H05B 6/6402* (2013.01); *F24C 15/2007* (2013.01); *H05B 6/642* (2013.01)

(58) Field of Classification Search
CPC ..... H05B 6/642; H05B 6/6423; H05B 6/6429; H05B 6/6402; F24C 15/2042; F24C 15/20; F24C 15/327; F24C 15/2007; F24C 15/006
See application file for complete search history.

(56) References Cited

U.S. PATENT DOCUMENTS 4,104,957 A * 8/1978 Freedman ..... A47J 31/106 219/689
4,327,274 A * 4/1982 White ..... F24C 15/2042 126/198
(Continued)

FOREIGN PATENT DOCUMENTS

CA 2299892 A1 * 9/2000
JP 8-42858 A 2/1996
(Continued)

*Primary Examiner* — David Angwin
*Assistant Examiner* — Gyounghyun Bae
(74) *Attorney, Agent, or Firm* — Birch, Stewart, Kolasch & Birch, LLP

(57) ABSTRACT

A casing, a heating chamber that is provided in the casing and that has an opening on a front face thereof, an exhaust tube for guiding exhaust from inside of the heating chamber to front face side of the casing, a cooling fan that is provided in the casing, and an exhaust duct having an exhaust inlet to which the other end of the exhaust tube is connected are provided. Position along height direction of a cooling air inlet into which cooling air flows from under the exhaust duct is lower than position along the height direction of the discharge ports of the exhaust duct, and the position along the height direction of the cooling air inlet of the exhaust duct is lower than position along the height direction of the exhaust inlet of the exhaust duct. A heating cooker is provided that prevents the exhaust from the inside of the heating chamber from flowing into a main body thereof even if a fan for supplying air that is to be mixed with the exhaust breaks down.

10 Claims, 21 Drawing Sheets

(51) Int. Cl.

| | |
|---|---|
| ***H05B 6/50*** | (2006.01) |
| ***A23B 4/03*** | (2006.01) |
| ***A23L 1/164*** | (2006.01) |
| ***F24C 15/20*** | (2006.01) |

(56) References Cited

U.S. PATENT DOCUMENTS

| | | | | |
|---|---|---|---|---|
| 4,376,131 | A * | 3/1983 | Mori | G01N 33/02 219/707 |
| 5,015,812 | A * | 5/1991 | Kasai et al. | 219/707 |
| 5,235,148 | A * | 8/1993 | Yamaguchi et al. | 219/707 |
| 5,319,937 | A * | 6/1994 | Fritsch et al. | 62/3.62 |
| 5,512,737 | A * | 4/1996 | Miklos | 219/771 |
| 5,783,807 | A * | 7/1998 | Uehashi et al. | 219/685 |
| 5,981,929 | A * | 11/1999 | Maeda | H05B 6/6429 126/299 D |
| 2007/0163567 | A1* | 7/2007 | Kaneko et al. | 126/21 A |
| 2008/0223352 | A1* | 9/2008 | Ando et al. | 126/20 |
| 2009/0205625 | A1* | 8/2009 | Matsubayashi et al. | 126/21 A |
| 2010/0064902 | A1 | 3/2010 | Sakane et al. | |
| 2010/0154656 | A1* | 6/2010 | Yamamoto et al. | 99/467 |
| 2010/0199966 | A1* | 8/2010 | Iwamoto | H05B 6/642 126/21 R |
| 2010/0200577 | A1* | 8/2010 | Iwamoto | H05B 6/6429 219/757 |
| 2011/0132346 | A1 | 6/2011 | Sakane et al. | |
| 2011/0139014 | A1* | 6/2011 | Nishiura et al. | 99/324 |
| 2011/0168690 | A1* | 7/2011 | Tomomura et al. | 219/401 |
| 2012/0043318 | A1* | 2/2012 | Komuro | F24C 15/006 219/757 |

FOREIGN PATENT DOCUMENTS

| | | | |
|---|---|---|---|
| JP | 11-351581 | A | 12/1999 |
| JP | 2003-21341 | A | 1/2003 |
| JP | 2007-61515 | A | 3/2007 |
| JP | 2008-116094 | A | 5/2008 |
| JP | 2010-54178 | A | 3/2010 |
| JP | 2010-139177 | A | 6/2010 |

* cited by examiner

HEATING COOKER

TECHNICAL FIELD

The present invention relates to a heating cooker.

BACKGROUND ART

There has been a conventional heating cooker that performs cooking with use of steam (see JP 2008-116094 A (Patent Literature 1), for instance).

In the heating cooker having above configuration, exhaust from inside of a heating chamber is mixed and diluted with indoor air, so that temperature of the exhaust is decreased, and the exhaust is discharged from upper rear face side of a main body thereof toward front face side thereof. On condition that there are wall surfaces in vicinity of the rear face side of the heating cooker main body, shelves just thereover, and/or the like, corrosion, dense growth of mold and/or the like are thereby prevented that might be caused on the wall surfaces, shelves and/or the like by contact therewith of highly heated exhaust containing steam.

For the heating cooker that performs cooking with use of steam, in particular, there is difficulty in placement in a narrow space of a structure in which exhaust from the chamber is discharged from the rear face side toward the front face side of the main body.

The applicants have conceived a heating cooker that is capable of mixing in an exhaust duct a portion of air, from a cooling fan for cooling electric components in a main body, with exhaust from inside of a heating chamber and thereafter discharging the mixed exhaust from front face side of the main body. The heating cooker is described in order to facilitate understanding of the invention and is neither publicly known art nor the prior art.

On condition that the cooling fan breaks down in the heating cooker having a structure of the exhaust duct into which the portion of the air from the cooling fan is taken, however, there is a possibility that the exhaust from the inside of the heating chamber flows into the main body without being discharged to outside.

CITATION LIST

Patent Literature

PATENT LITERATURE 1: JP 2008-116094 A

SUMMARY OF INVENTION

Technical Problem

An object of the invention is to provide a heating cooker that prevents exhaust from inside of a heating chamber from flowing into a main body thereof even if a fan for supplying air that is to be mixed with the exhaust breaks down.

Solution to Problem

In order to achieve the object, a heating cooker of the invention comprises:

a casing, a heating chamber that is provided in the casing and that has an opening on a front face thereof, an exhaust path for guiding exhaust from inside of the heating chamber to front face side of the casing, a fan that is provided in the casing, and an exhaust duct having an exhaust inlet into which the exhaust from the exhaust path flows, an air inflow port into which a portion of air from the fan flows from underside, and at least one discharge port through which mixture of the exhaust having flowed in through the exhaust inlet and the portion of the air from the fan having flowed in through the air inflow port is discharged to outside, wherein position along height direction of the air inflow port of the exhaust duct is lower than position along the height direction of the discharge port of the exhaust duct, and wherein the position along the height direction of the air inflow port of the exhaust duct is lower than position along the height direction of the exhaust inlet of the exhaust duct.

In above configuration, the highly heated exhaust containing steam from the inside of the heating chamber is guided by the exhaust path to the front face side of the casing and flows through the exhaust path and the exhaust inlet into the exhaust duct when cooking is performed. The exhaust that has flowed into the exhaust duct is mixed with the portion of the air from the fan that has flowed in through the air inflow port and is forced to be discharged to the outside through the discharge port by wind pressure of the air from the fan. Thus the mixed exhaust mixed in the exhaust duct can be discharged from the front face side of a main body thereof. The position along the height direction of the air inflow port into which the air flows from under the exhaust duct is lower than the position along the height direction of the discharge port of the exhaust duct, and the position along the height direction of the air inflow port of the exhaust duct is lower than the position along the height direction of the exhaust inlet of the exhaust duct, so that the exhaust that flows through the exhaust inlet of the exhaust duct into the exhaust duct when the fan is stopped due to breakdown or the like is prevented from flowing out through the air inflow port that is in the lowest position because the exhaust is initially and gradually accumulated from upside in the exhaust duct and is thereafter discharged to the outside through the discharge port that is in the higher position along the height direction than the air inflow port. Accordingly, the exhaust from the inside of the heating chamber can be prevented from flowing into the casing even if the fan for supplying air that is to be mixed with the exhaust breaks down.

In the heating cooker in accordance with an embodiment, the exhaust inlet is provided in an air path between the air inflow port and the discharge port in the exhaust duct, and wherein a shield wall is provided between the air inflow port and the exhaust inlet in the exhaust duct.

In the embodiment, flow of the exhaust that has flowed in from the inside of the heating chamber through the exhaust path and the exhaust inlet can be prevented from being disturbed by the air that has flowed in from the air inflow port and from being reversed toward the exhaust inlet, by the provision of the exhaust inlet in the air path between the air inflow port and the discharge port in the exhaust duct and the provision of the shield wall between the air inflow port and the exhaust inlet.

In the heating cooker in accordance with an embodiment, the shield wall is a wall that has a section shaped like a letter U so as to surround a side for the air inflow port, of a columnar region extended from the exhaust inlet into the exhaust duct and so as to open on a side of the columnar region for the discharge port.

In the embodiment, the exhaust from the exhaust inlet can be drawn into the exhaust duct by ejector effect owing to difference in flow velocity between flow of the air from the air inflow port and the exhaust from the exhaust inlet, because the shield wall opens on the side for the discharge port in the air path from the air inflow port to the discharge port, with use of the shield wall that has the section shaped like a letter U so as to surround the side for the air inflow port, of the columnar region extended from the exhaust inlet into the exhaust duct and so as to open on the side of the columnar region for the discharge port. Thus the exhaust flowing in through the exhaust inlet can smoothly be merged with the air from the air inflow port.

In the heating cooker in accordance with an embodiment, the exhaust duct comprises a plurality of the discharge ports.

Even if quantity of the exhaust is sharply increased according to types of objects to be heated in the heating chamber and/or the like, in the embodiment, discharge of highly heated exhaust can be prevented by the plurality of discharge ports of the exhaust duct because the exhaust is dispersively discharged to the outside through the plurality of discharge ports.

In the heating cooker in accordance with an embodiment, the air inflow port is placed in a region except a region immediately under the exhaust inlet in the exhaust duct.

Even if condensate water produced in the exhaust path and/or the like drops from the exhaust inlet of the exhaust duct when the exhaust from the inside of the heating chamber flows through the exhaust path into the exhaust duct, in the embodiment, the placement of the air inflow port in the region except the region immediately under the exhaust inlet in the exhaust duct prevents leakage of the water through the air inflow port that is lower in position along the height direction than the exhaust inlet.

In the heating cooker in accordance with an embodiment, the exhaust duct is bent between the air inflow port and the discharge ports and on a position that is nearer to the discharge ports than to the exhaust inlet.

In the embodiment, the exhaust duct is bent between the air inflow port and the discharge ports and on the side of the exhaust inlet that is nearer to the discharge ports in the exhaust duct, the exhaust that has flowed through the exhaust inlet into the exhaust duct is mixed with the portion of the air from the fan that has flowed in through the air inflow port, in the air path between the air inflow port and the discharge ports, and the mixed exhaust is thereafter turned and guided to the discharge ports. Thus efficient mixture of the exhaust and the air results in uniform temperature of the mixed exhaust that is discharged to the outside through the discharge ports and prevents discharge of highly heated exhaust with biased temperature distribution.

In the heating cooker in accordance with an embodiment, bottom part in the exhaust duct has an inclined surface that gradually lowers from side of the exhaust inlet toward side of the discharge ports.

Even if condensate water produced in the exhaust path and/or the like drops from the exhaust inlet of the exhaust duct when the exhaust from the inside of the heating chamber flows through the exhaust path into the exhaust duct, in the embodiment, the bottom part of the exhaust duct having the inclined surface that gradually lowers from the side of the exhaust inlet toward the side of the discharge ports causes the condensate water to flow from the side of the exhaust inlet toward the side of the discharge ports along the inclined surface on the bottom part of the exhaust duct and to be discharged to the outside through the discharge ports and prevents the condensate water from being accumulated in the exhaust duct.

In the heating cooker in accordance with an embodiment, a partition wall of which top end is higher than the bottom part immediately under the exhaust inlet in the exhaust duct is provided in an air path between the air inflow port and the exhaust inlet in the exhaust duct.

Even if condensate water produced in the exhaust path and/or the like drops from the exhaust inlet of the exhaust duct when the exhaust from the inside of the heating chamber flows through the exhaust path into the exhaust duct, in the embodiment, the partition wall of which the top end is higher than the bottom part immediately under the exhaust inlet in the exhaust duct and which is provided in the air path between the air inflow port and the exhaust inlet in the exhaust duct prevents the condensate water from flowing toward the air inflow port that is lower in position along the height direction than the exhaust inlet.

In the heating cooker in accordance with an embodiment, the exhaust duct comprises drain guide grooves that are provided on outside of side walls of the exhaust duct and that guide drain from the side of the exhaust inlet toward the side of the discharge ports and a drain port that is provided on a side nearer to the discharge ports than to the exhaust inlet in the drain guide grooves.

According to the embodiment, because of using the exhaust duct having the drain guide grooves that are provided on the outside of the side walls of the exhaust duct and that guides drain from the side of the exhaust inlet toward the side of the discharge ports and the drain port that is provided on the side nearer to the discharge ports than to the exhaust inlet in the drain guide grooves, condensate water produced in the casing and/or the like, for instance, is received and gathered, and the gathered drain is thereafter guided toward the drain port by the drain guide grooves of the exhaust duct and is discharged through the drain port to the outside. By the condensate water flowing in the drain guide grooves on the side walls of the exhaust duct, in this manner, the exhaust duct can be cooled, temperature of the mixed exhaust in the exhaust duct can be decreased, and effect of cooling the exhaust can be improved. In addition, the one exhaust duct is capable of combining exhaust disposal function and drain disposal function.

The heating cooker in accordance with an embodiment comprises a dew receiving container that is placed under the opening of the heating chamber, that receives the exhaust from the discharge ports of the exhaust duct, and that diffuses the exhaust to outside of the casing.

According to the embodiment, because the mixed exhaust from the discharge ports of the exhaust duct is received and is diffused to the outside of the casing by the dew receiving container that is placed under the opening of the heating chamber, the mixed exhaust having a decreased temperature by being cooled can be received by the dew receiving container on the front face side and can be diffused to vast outside space on the front face side of the casing.

Advantageous Effects of Invention

According to the heating cooker of the invention, as apparent from the above, the heating cooker can be provided that prevents the exhaust from the inside of the heating chamber from flowing into the main body thereof even if the fan for supplying the air that is to be mixed with the exhaust breaks down.

DESCRIPTION OF EMBODIMENTS

Figure 1:
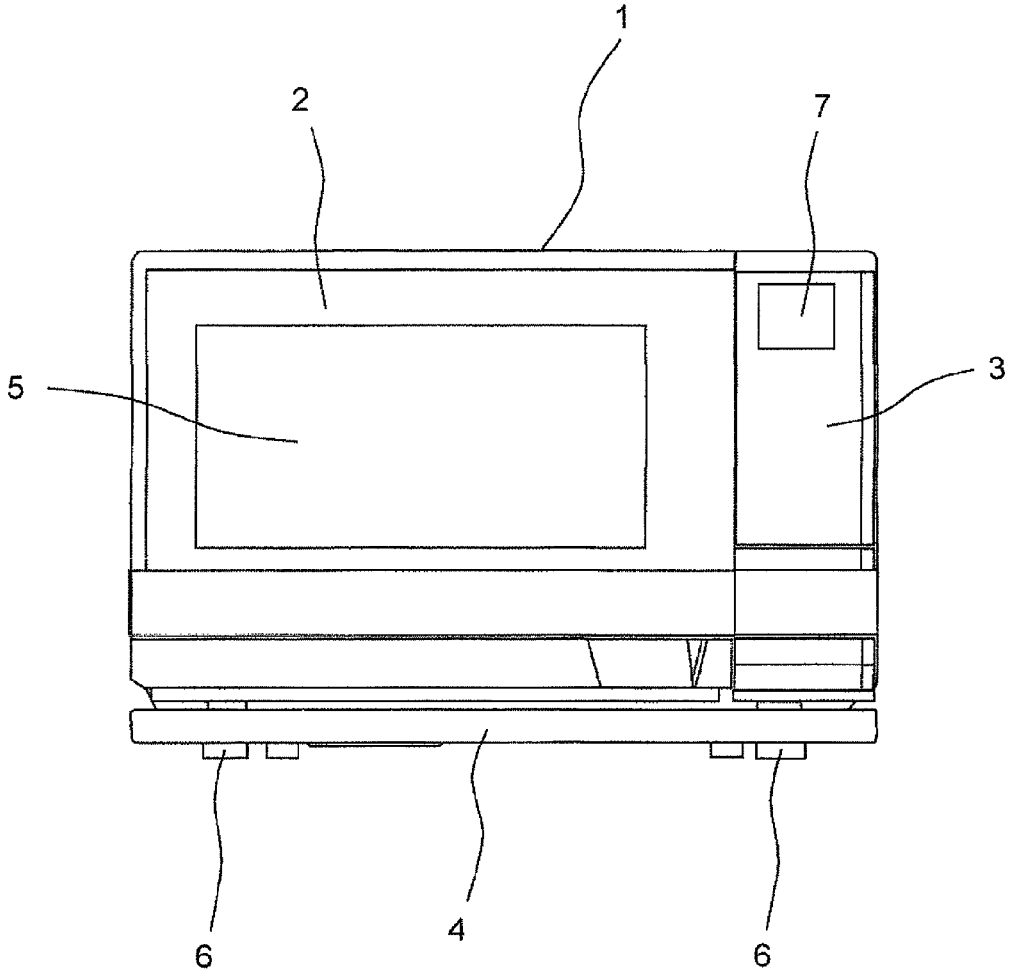
FIG. 1 is a front view of a heating cooker in accordance with an embodiment of the invention.

Hereinbelow, a heating cooker of the invention will be described in detail with reference to an embodiment shown in the drawings.

FIG. 1 is a front view of the heating cooker in accordance with the embodiment of the invention.

As shown in FIG. 1, the heating cooker has a casing 1 and a door 2 with a handle, as an example of a door that is mounted on front face side of the casing 1. Heat resistant glass 5 is mounted at general center of the door 2 with handle. An operation panel 3 is provided on the front face side of the casing 1 so as to adjoin the door 2 with handle that is closed. A dew receiving container 4 as an example of an exhaust receiving part is provided under the door 2 with handle and the operation panel 3.

A plurality of push buttons and the like are mounted on the operation panel 3. The operation panel 3 has a liquid crystal display part 7, which provides a display according to an operation.

The dew receiving container 4 is a container that is attachable to and detachable from two front legs 6, 6 provided on front side on bottom part of the casing 1. Once the dew receiving container 4 is inserted to underside of the casing 1 from the front side toward rear side and is mounted on the front legs 6, 6, a portion of the dew receiving container 4 is positioned under a rear face (back face) of the door 2 with handle that is closed. Thus condensate water deposited on the rear face of the door 2 with handle drops into the dew receiving container 4 placed under an opening 8*a* (shown in FIG. 8) of the heating chamber 8 (shown in FIG. 8) when the door 2 with handle is opened.

Figure 2:
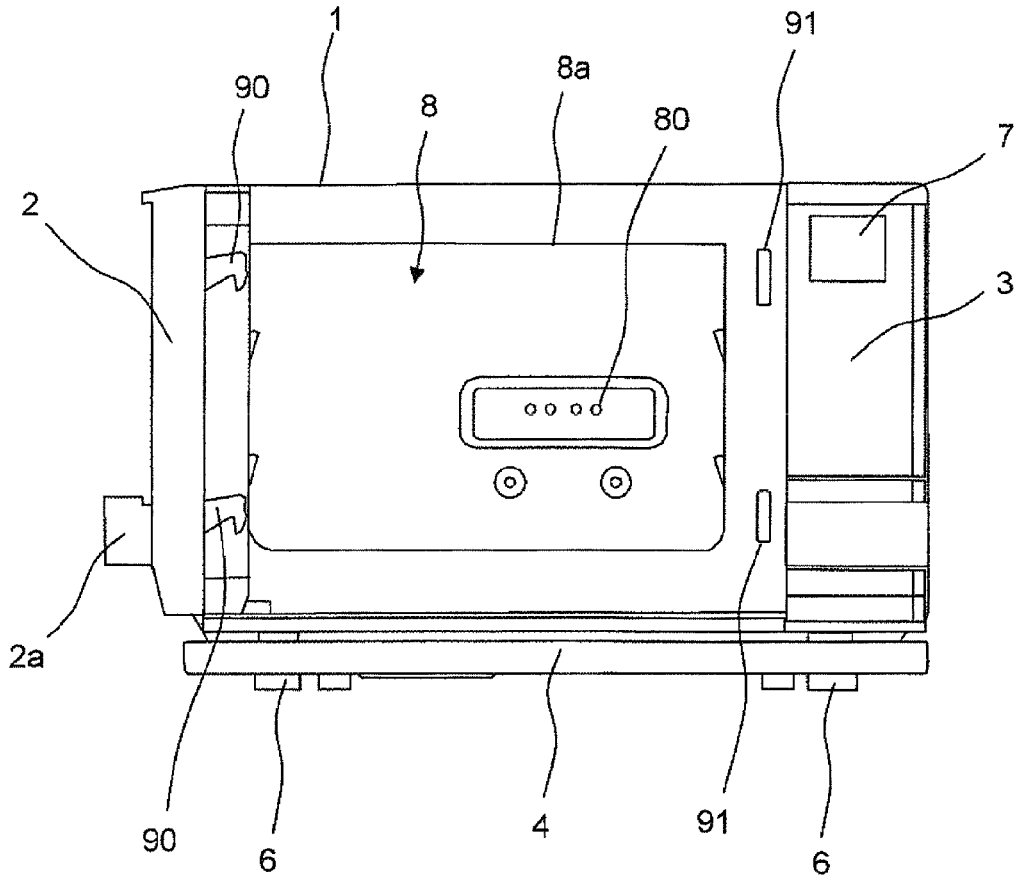
FIG. 2 is a front view of the heating cooker having a door with handle fully opened.
Figure 3:
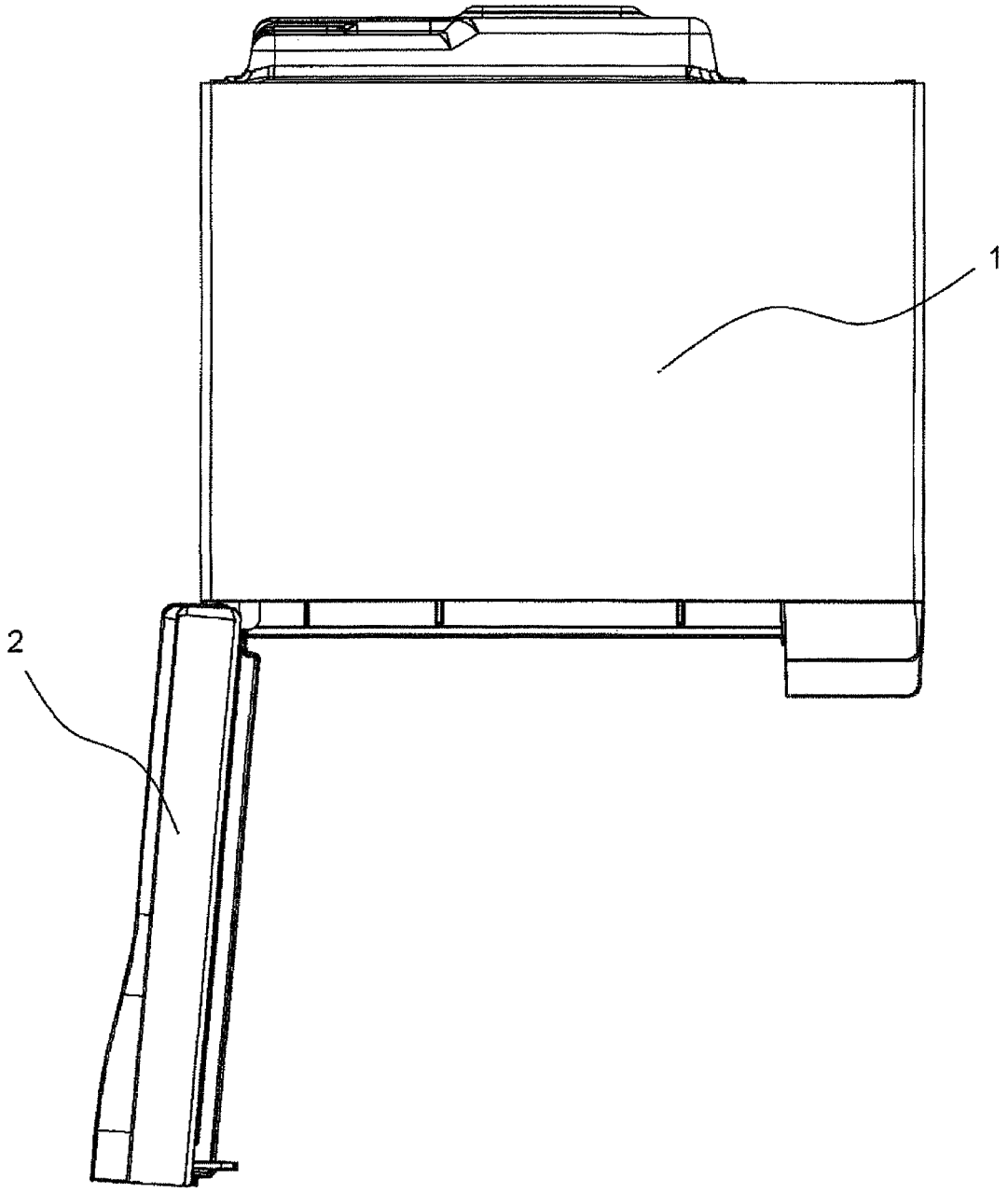
FIG. 3 is a top plan view of the heating cooker having the door with handle fully opened.

FIG. 2 shows a front view of the heating cooker with the door 2 with handle fully opened, as seen looking from the front face side, and FIG. 3 shows a top plan view of the heating cooker. In FIGS. 2 and 3, the same components as those of the heating cooker shown in FIG. 1 are provided with the same reference numerals.

As shown in FIGS. 2 and 3, the heating chamber 8 for heating an object 23 (see FIG. 4) to be heated is provided in the casing 1. The door 2 with handle that is provided on the front face side of the casing 1 pivots in left and right directions on left side end part of the casing 1 and opens and closes the opening 8*a* (shown in FIG. 8) on the front face of the heating chamber 8 (shown in FIG. 4). The door 2 with handle is pivotably mounted through hinges (not shown) on a side part of the casing 1 that is opposed to the operation panel 3.

Latch hooks 90, 90 are provided on right side and on the rear face of the door 2 with handle. When the door 2 with handle is closed, the latch hooks 90, 90 are inserted into insertion holes 91, 91 provided on periphery of the opening 8*a* and are releasably engaged with latch mechanisms (not shown) in the casing 1. The engagement of the latch hooks 90, 90 can be released by a grasp by a user on the handle 2*a* of the door 2 with handle.

In FIG. 2, numeral 80 denotes steam blow-off ports through which steam produced by a steam producing device 13 (shown in FIG. 5) is blown into the heating chamber 8.

Figure 4:
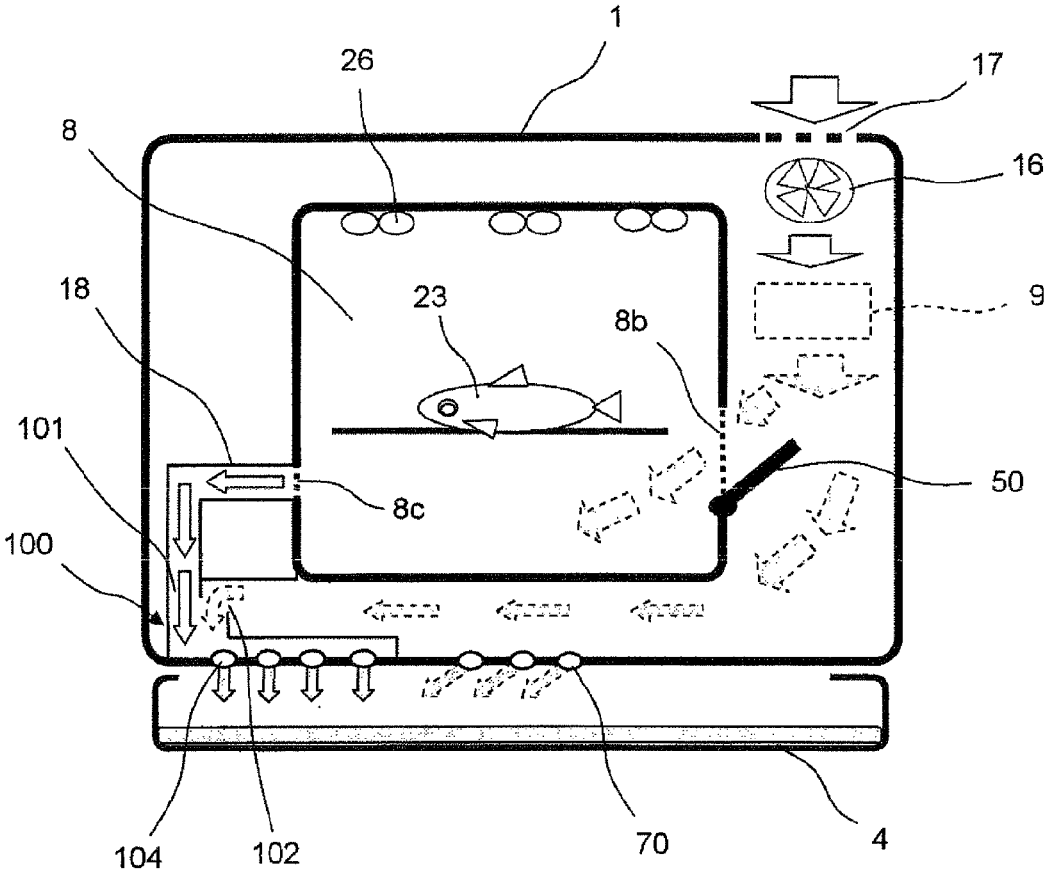
FIG. 4 is a schematic section of the heating cooker.

FIG. 4 shows a schematic section of the heating cooker. In FIG. 4, numeral 26 denotes heaters placed on upper side in the heating chamber 8.

In the heating cooker, as shown in FIG. 4, a portion of air taken in by a cooling fan 16 from outside through an air intake 17 passes through an electric component chamber 9 as an example of a cooling space and thereafter flows into the heating chamber 8 through an air supply port 8*b* that is in open state with opening of an air supply damper 50. On the other hand, the other portion of the air taken in from the outside passes through the electric component chamber 9, thereafter flows to bottom part side of the casing 1, and then flows through an air path under the heating chamber 8 into a cooling air inlet 102 as an example of an air inflow port of an exhaust duct 100.

The portion of the air in the heating chamber 8 is discharged into the exhaust duct 100 through an exhaust port 8*c* and an exhaust tube 18 as an example of an exhaust path and is mixed with air having flowed in through an exhaust inlet 101, in the exhaust duct 100. Then the exhaust diluted in the exhaust duct 100 is blown downward through four discharge ports 104 into the dew receiving container 4.

The portion of the air that flows to the bottom part side of the casing 1 and that then flows through the air path under the heating chamber 8 is blown through a plurality of cooling air blow-off ports 70, provided on the front face side on a bottom plate 30 (shown in FIG. 9) of the casing 1, toward a region S (FIG. 17) in the dew receiving container 4 that receives and diffuses the exhaust from the discharge ports 104.

Figure 5:
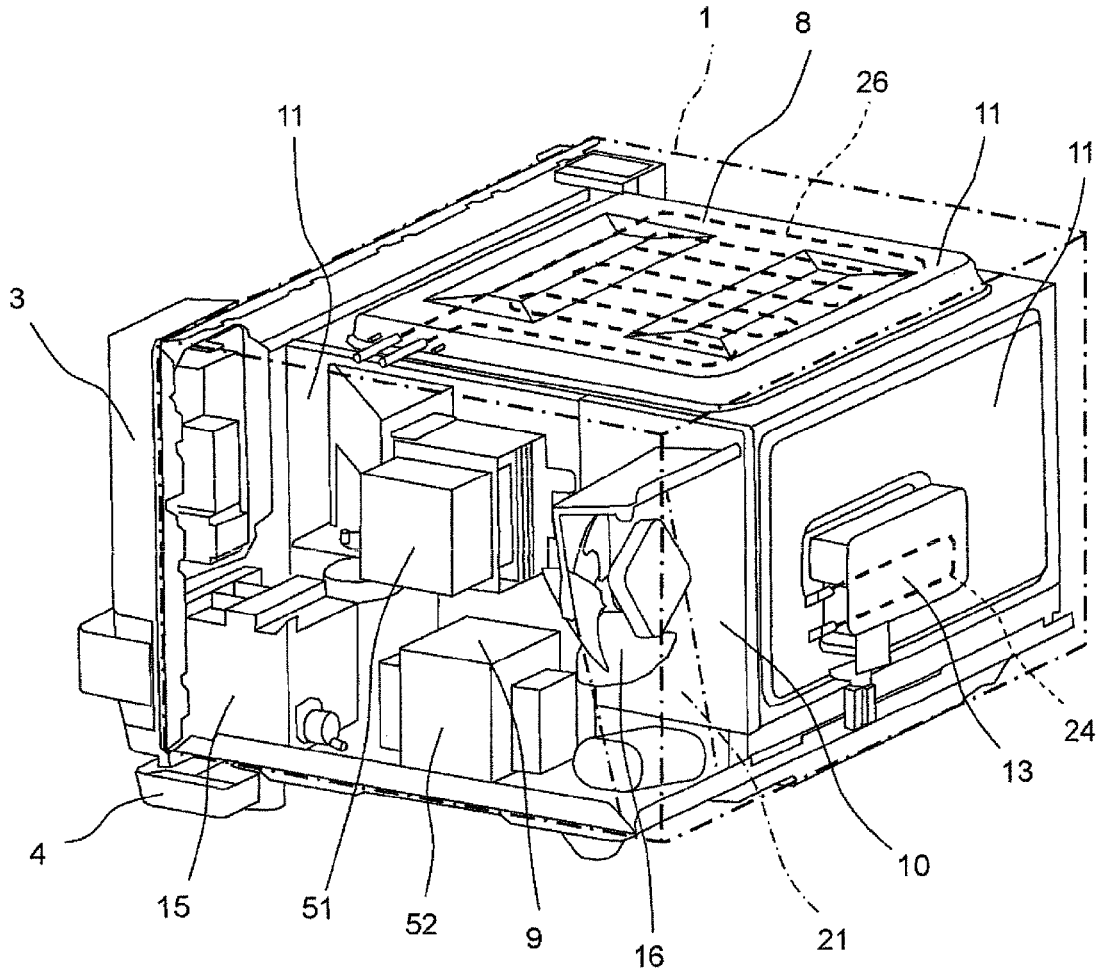
FIG. 5 is a perspective view of the heating cooker from which a casing has been removed, as seen looking from rear and diagonally upper side.

FIG. 5 shows a perspective view of the heating cooker from which the casing 1 has been removed, as seen looking from rear and diagonally upper side.

As shown in FIG. 5, the heating chamber 8 for heating the object 23 (shown in FIG. 4) to be heated is provided in the casing 1. In the casing 1, the electric component chamber 9 as the example of the cooling space is provided on a lateral side of the heating chamber 8 and on the rear side of the operation panel 3, and an air intake space 10 is provided on the rear side of the heating chamber 8 and on the rear side of the electric component chamber 9.

Heat shield plates 11, 11, . . . are provided on top, bottom, rear side, and both lateral sides of the heating chamber 8, respectively. That is, the heat shield plates 11, 11, . . . are provided around the heating chamber 8 except for the opening 8*a*. Spaces between the heat shield plates and the heating chamber 8 are filled with heat insulating material (not shown).

The steam producing device 13 for producing steam that is supplied into the heating chamber 8 is provided on the rear face side of the heating chamber 8, and a water supply pump (not shown) connected to the steam producing device 13 through a water supply tube is provided under the heating chamber 8. A tank housing part 15 in which a water supply tank (not shown) is housed, a magnetron 51, a power supply transformer 52 and the like are provided in the electric component chamber 9 in the casing 1. When the object 23 to be heated is heated, the cooling air from the cooling fan 16 flows through the electric component chamber 9 so that electric components such as the magnetron 51 can be cooled.

With drive of the cooling fan 16, air outside the casing 1 flows through a plurality of air intakes (not shown) into the air intake space 10. The air in the air intake space 10 is delivered into the electric component chamber 9 by the cooling fan 16. The air intakes are each composed of a plurality of slits provided in rear part of the casing 1.

In FIG. 5, numeral 21 denotes a partition wall that serves as a partition between the electric component chamber 9 and the air intake space 10. The cooling fan 16 is mounted on the partition wall 21. The heaters 26 are provided on the upper side in the heating chamber 8. Microwaves produced by the magnetron 51 are guided through a waveguide (not shown) to center of lower part in the heating chamber 8, are radiated toward upside in the heating chamber 8 while being stirred by a rotating antenna (not shown), and thereby heat the object 23 (shown in FIG. 4) to be heated.

Water in the water supply tank housed in the housing part 15 is supplied through the water supply tube (not shown) to the steam producing device 13 by drive of the water supply pump. The steam producing device 13 heats the water from the water supply pump by a steam producing heater 24 and thereby produces steam.

Figure 6:
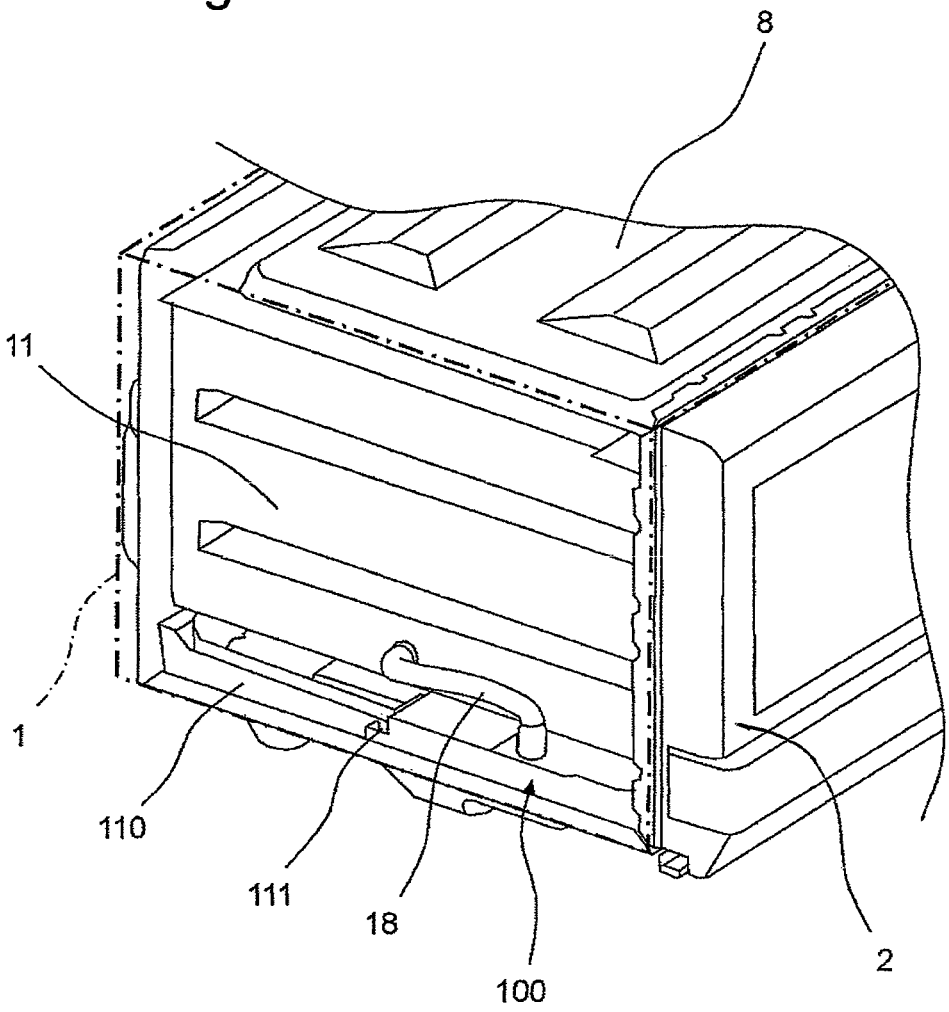
FIG. 6 is a perspective view of the heating cooker from which the casing has been removed, as seen looking from front and diagonally upper side.
Figure 7:
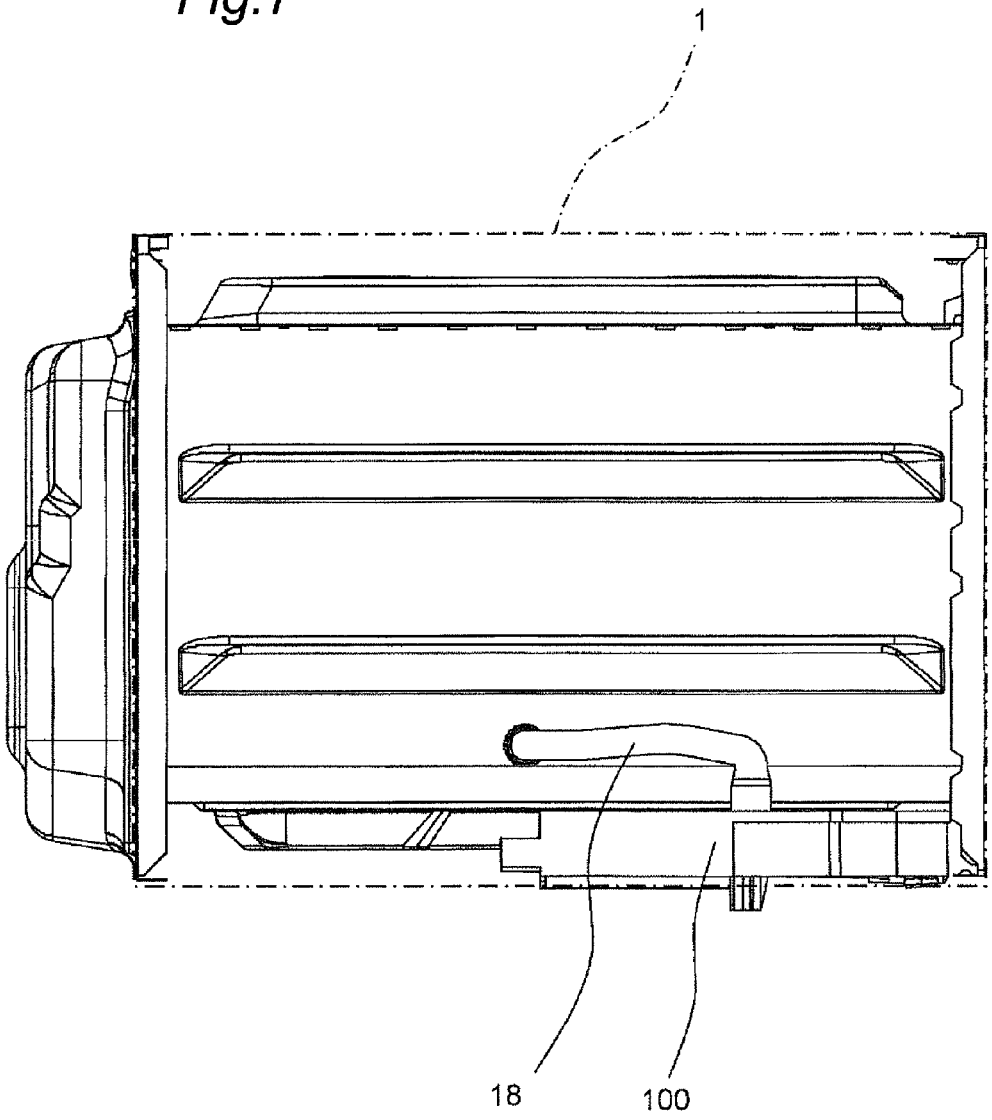
FIG. 7 is a left side view of the heating cooker from which the casing has been removed.

FIG. 6 shows a perspective view of the heating cooker from which the casing 1 has been removed, as seen looking from front and diagonally upper side, and FIG. 7 shows a left side view of the heating cooker from which the casing 1 has been removed. As shown in FIGS. 6 and 7, an upstream end of the exhaust tube 18 is connected to the exhaust port 8*c* (shown in FIG. 4) provided on a left side wall of the heating chamber 8, and a downstream end (exhaust outlet) of the exhaust tube 18 is connected to the exhaust duct 100 made of synthetic resin and provided on lower left side and the front face side in the casing 1. The exhaust tube 18 is made of synthetic resin having flexibility.

Gas in the heating chamber 8 is guided from a side part to the front face side of the casing 1 by the exhaust tube 18 and the exhaust duct 100 and is then discharged to the outside of the casing 1.

An extremity part of a drain groove 110 is connected to a drain receiving part 111 on the rear face side of the exhaust duct 100. The drain groove 110 receives condensate water dropping along side faces of the heat shield plates 11 that cover the heating chamber 8. The drain groove 110 is omitted in FIG. 7.

Figure 8:
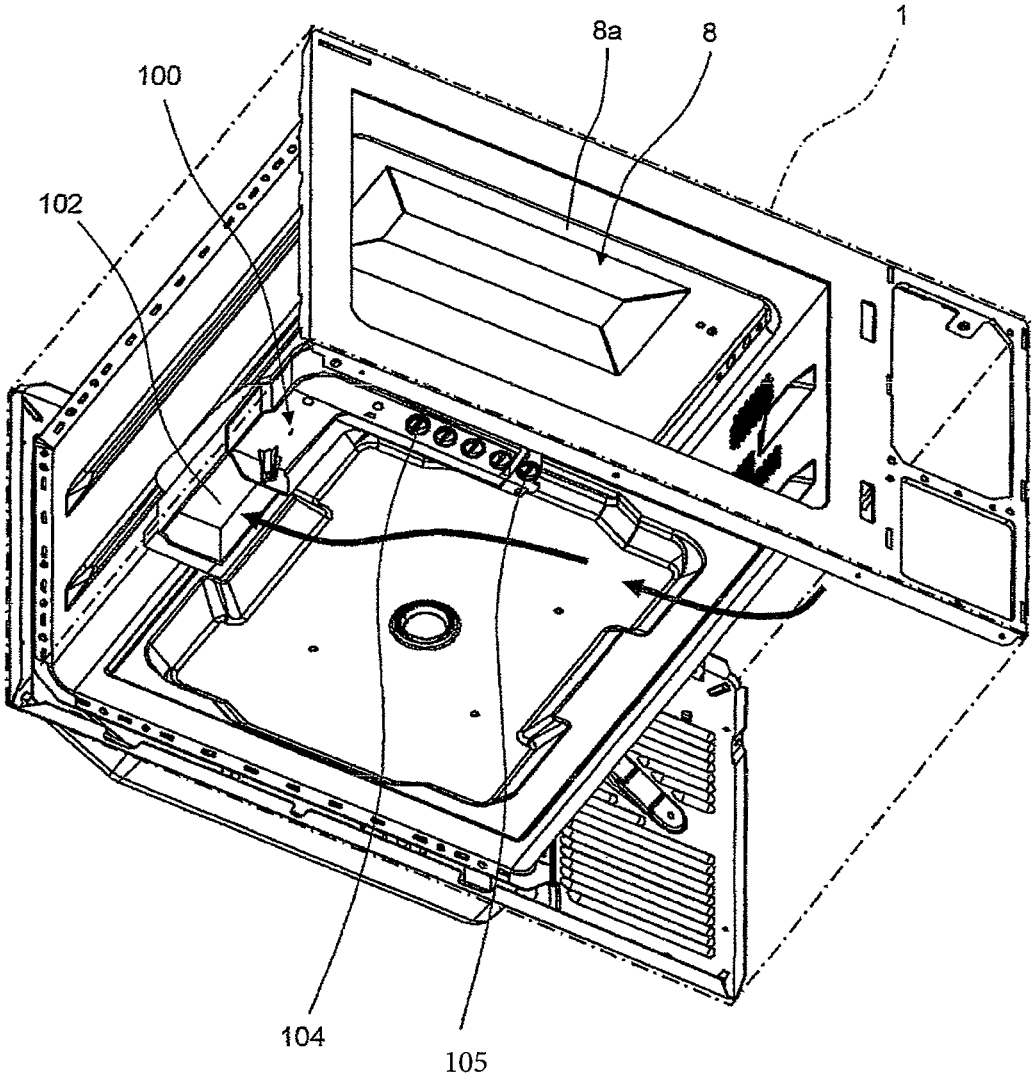
FIG. 8 is a perspective view of the heating cooker from which the casing and a bottom plate have been removed, as seen looking from front and diagonally lower side.

FIG. 8 shows a perspective view of the heating cooker from which the casing 1 and the bottom plate 30 (shown in FIG. 9) have been removed, as seen looking from front and diagonally lower side, and the exhaust duct 100 shaped like a letter L is placed on a corner part on front left and lower side of the casing 1. The cooling air inlet 102 is provided on the rear face side and lower side of the exhaust duct 100 so that opening thereof faces downward, the four discharge ports 104 are provided at specified intervals along left and right direction on the front face side and the lower side of the exhaust duct 100, and a drain port 115 is provided at right of the discharge ports 104.

Figure 9:
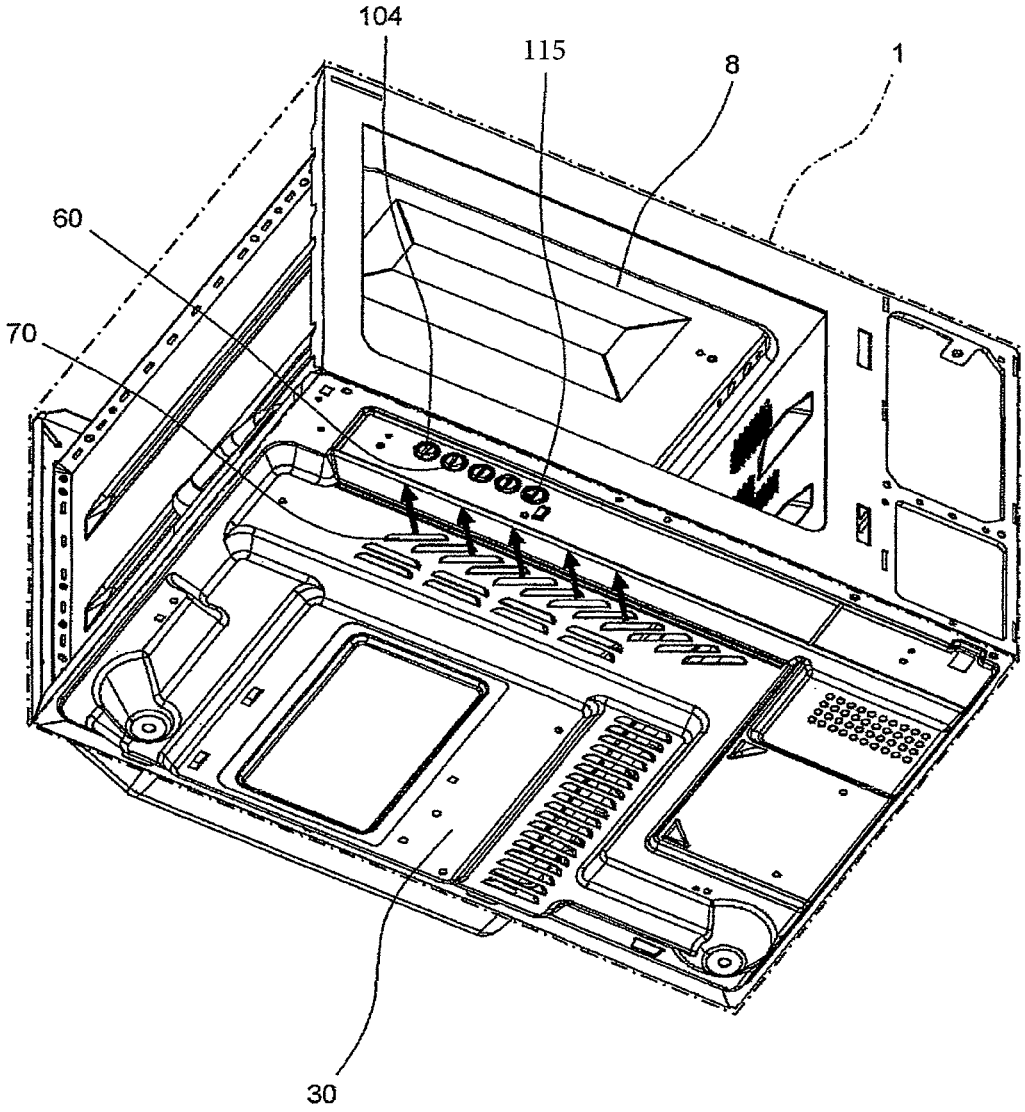
FIG. 9 is a perspective view of the heating cooker which is shown in FIG. 8 and on which the bottom plate is mounted, as seen looking from the front and diagonally lower side.

FIG. 9 shows a perspective view of the heating cooker which is shown in FIG. 8 and on which the bottom plate 30 is mounted, as seen looking from the front and diagonally lower side. As shown in FIG. 9, five circular holes 60 corresponding to the four discharge ports 104 and to the drain port 115 on the front face side and the lower side of the exhaust duct 100 (shown in FIG. 8) are provided on the front face side of the bottom plate 30 of the casing 1.

Provided on the front face side on the bottom plate 30 of the casing 1 and on the rear face side of the circular holes 60 are the plurality of cooling air blow-off ports 70 through which a portion of the cooling air from the cooling fan 16 (shown in FIG. 5) is blown off toward the region S (shown in FIG. 17) in the dew receiving container 4 (shown in FIGS. 11, 12) that receives and diffuses the exhaust from the discharge ports 104.

Figure 10:
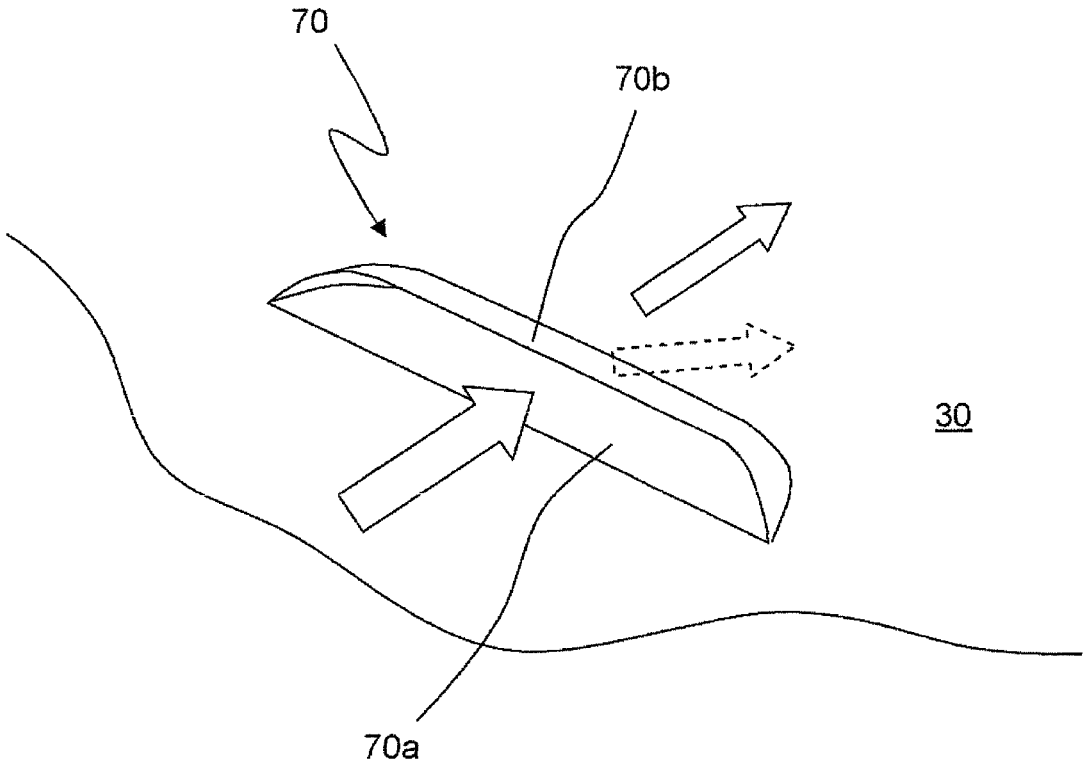
FIG. 10 is a perspective view of a cooling air blow-off port having a slit part and a raised part, as seen looking from rear and diagonally upper side.

As shown in FIG. 10, the cooling air blow-off ports 70 have a plurality of slit parts 70*a* arranged at specified intervals along the left and right direction and cut and raised parts 70*b* as cooling air guiding parts that are provided on one (downwind side for the cooling air) of longitudinal edges of the slit parts 70*a*. Longitudinal direction of the slit parts 70*a* is inclined with respect to the left and right direction along bottom edge of the front face of the casing 1 so as to extend from rear left face side toward front right face side. The cut and raised parts 70*b* of the cooling air blow-off ports 70 are formed by cutting on and raising of the casing 1 toward inside (upside in FIG. 10).

The cut and raised parts 70*b* are provided as the cooling air guiding parts in the cooling air blow-off ports 70 in the embodiment, whereas the cooling air guiding parts are not limited thereto and flow of the cooling air may be controlled by separate members.

Figure 11:
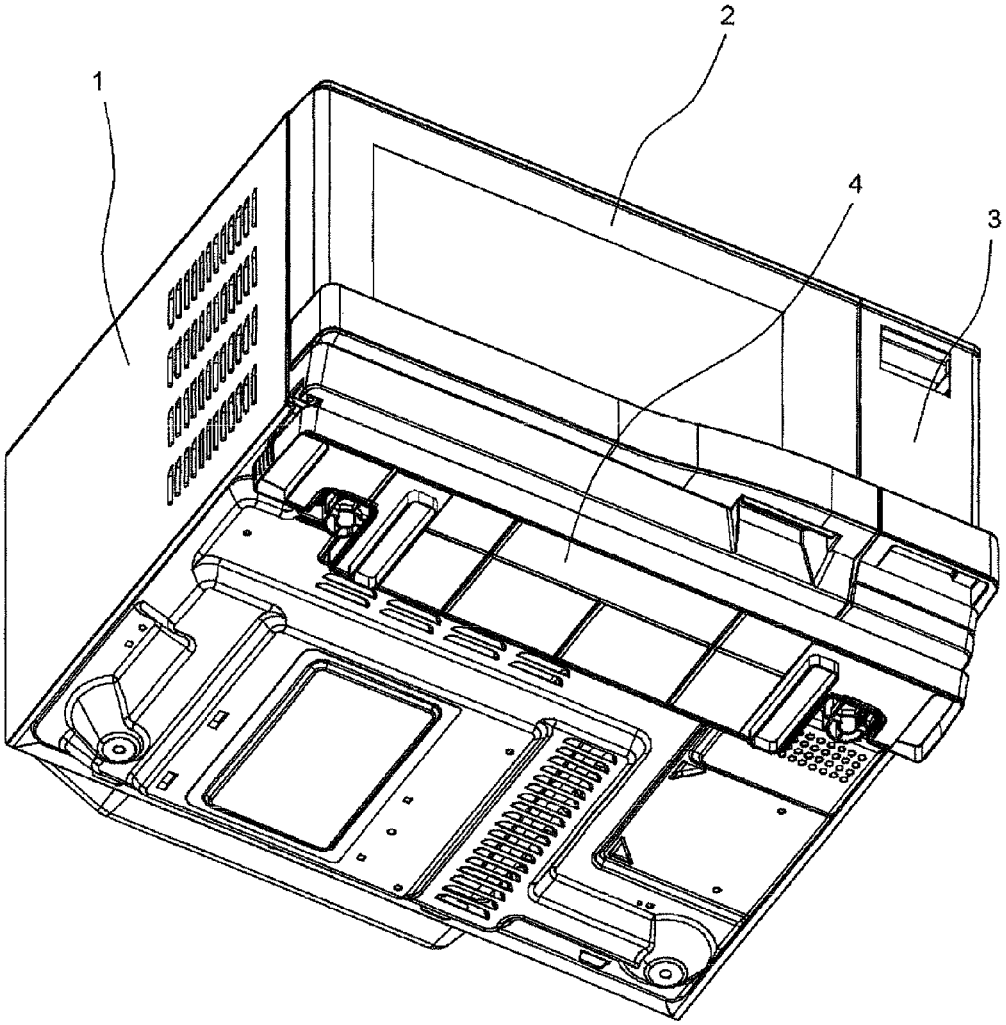
FIG. 11 is a perspective view of the heating cooker which is shown in FIG. 9 and to which a dew receiving container is attached, as seen looking from the front and diagonally lower side.
Figure 12:
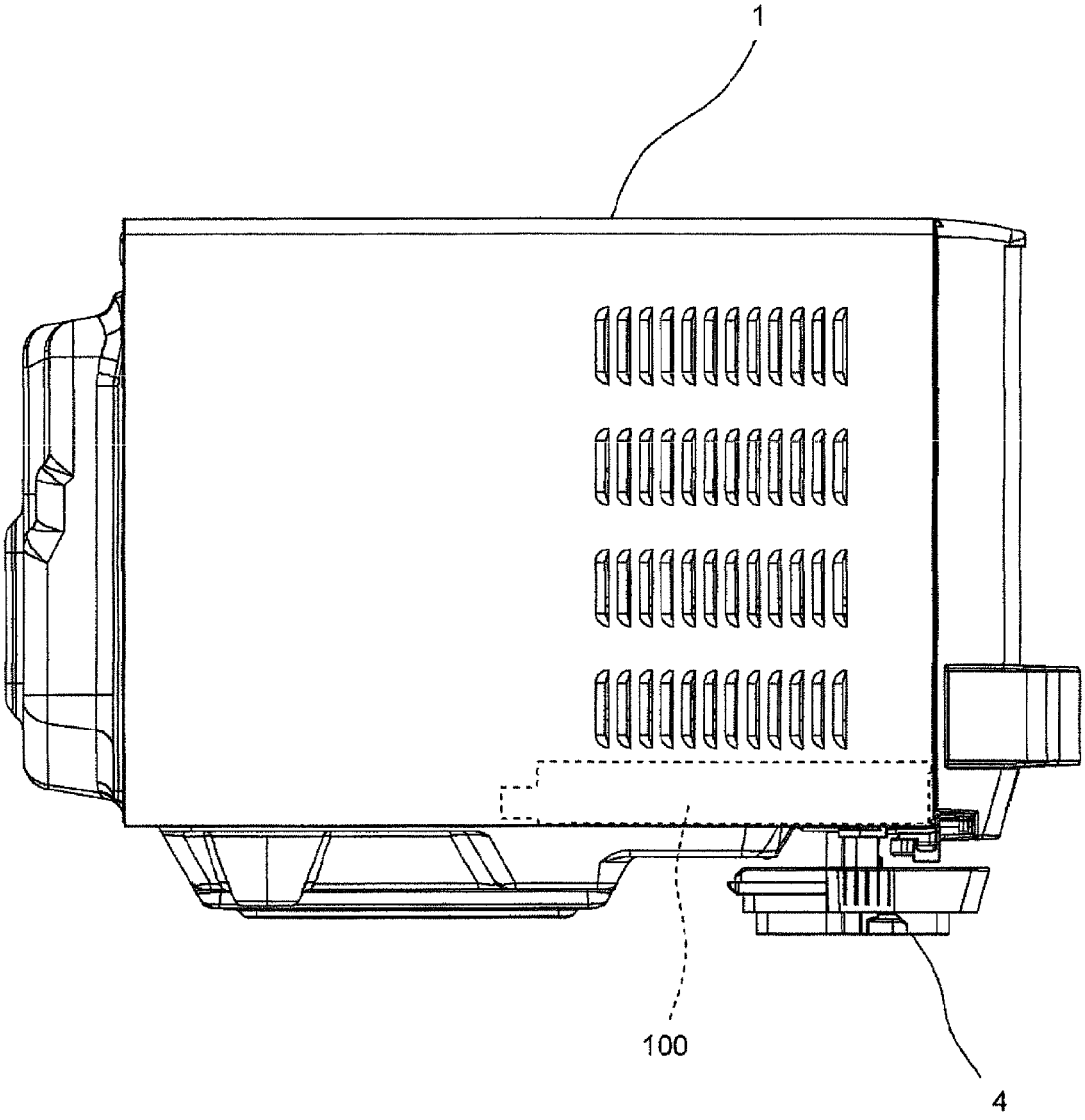
FIG. 12 is a left side view of the heating cooker.

By the cut and raised parts 70*b* of the cooling air blow-off ports 70, the portion of the cooling air that flows through between a bottom face of the heating chamber 8 and the bottom plate 30 from the electric component chamber 9 (shown in FIG. 5) on right side toward left side where the exhaust duct 100 (shown in FIG. 8) exists is blown off through the cooling air blow-off ports 70 toward the region S (shown in FIG. 17) facing the discharge ports 104 in the dew receiving container 4 (shown in FIGS. 11, 12).

FIG. 11 shows a perspective view of the heating cooker which is shown in FIG. 9 and to which the dew receiving container 4 is attached, as seen looking from the front and diagonally lower side. In FIG. 11, the casing 1, the door 2 with handle, and the operation panel 3 are also mounted thereon.

FIG. 12 is a left side view of the heating cooker shown in FIG. 11.

Figure 13:
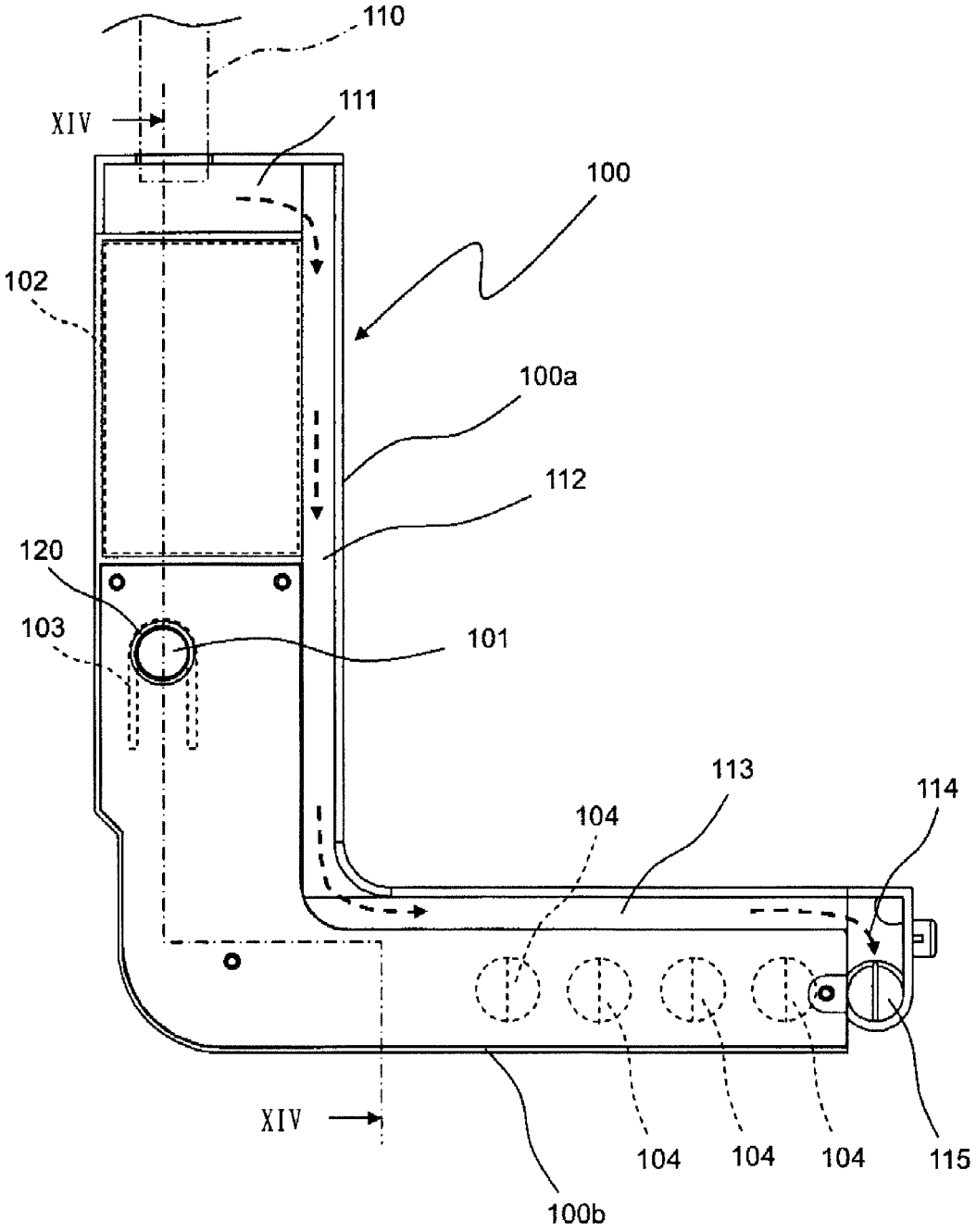
FIG. 13 is a top plan view of an exhaust duct of the heating cooker.
Figure 14:
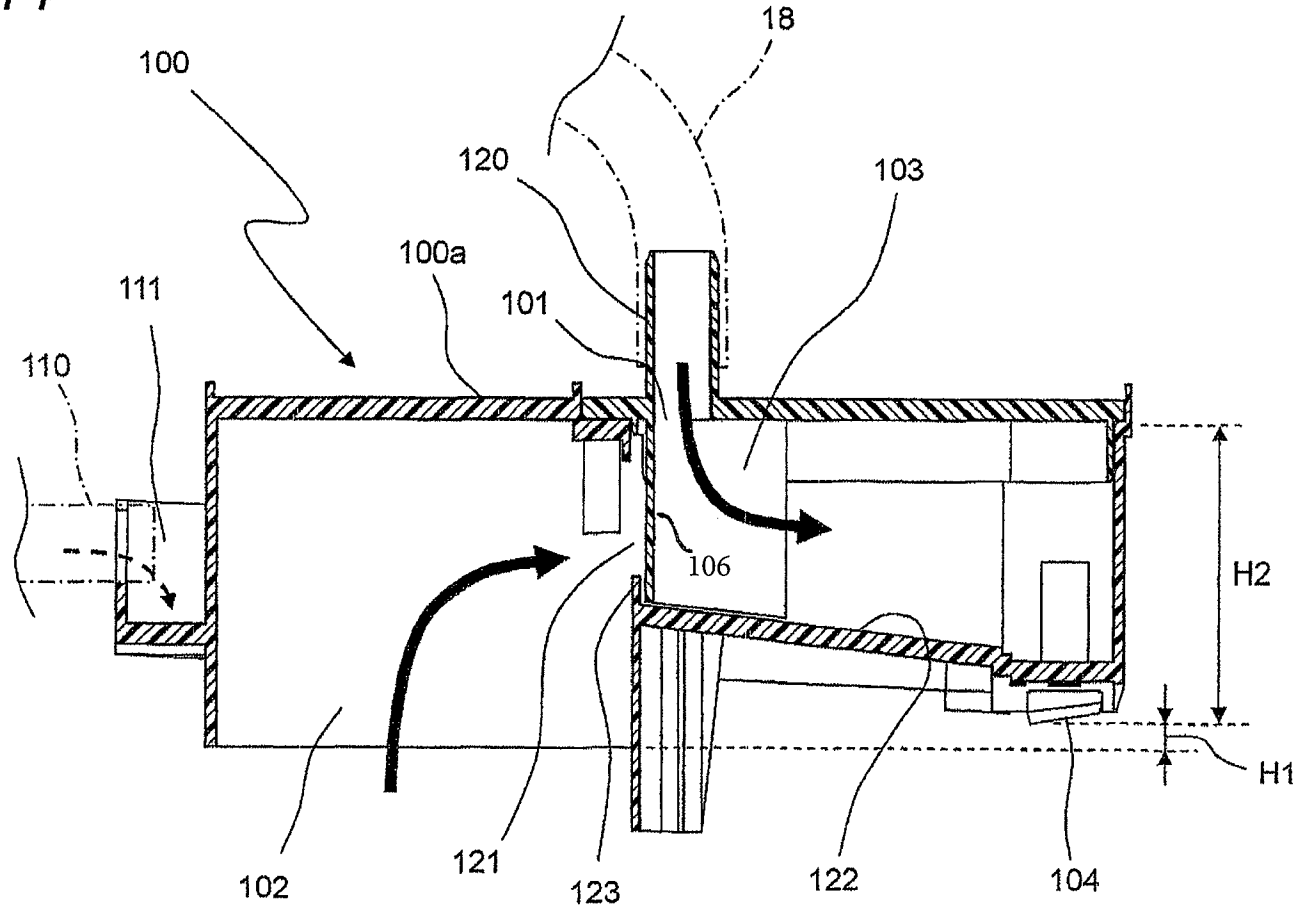
FIG. 14 is a sectional view taken along a line XIV-XIV of FIG. 13.
Figure 15:
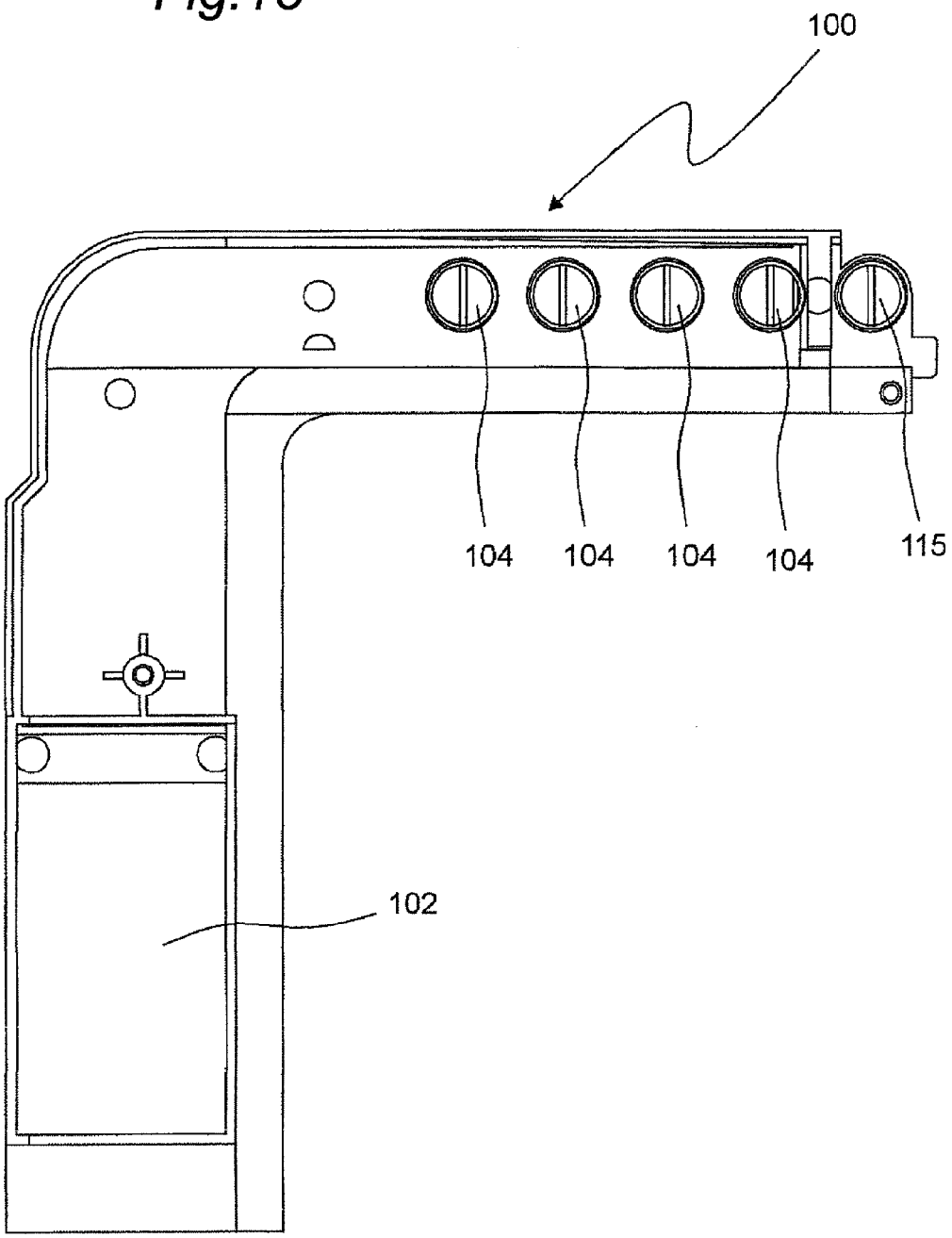
FIG. 15 is a bottom plan view of the exhaust duct.
Figure 16:
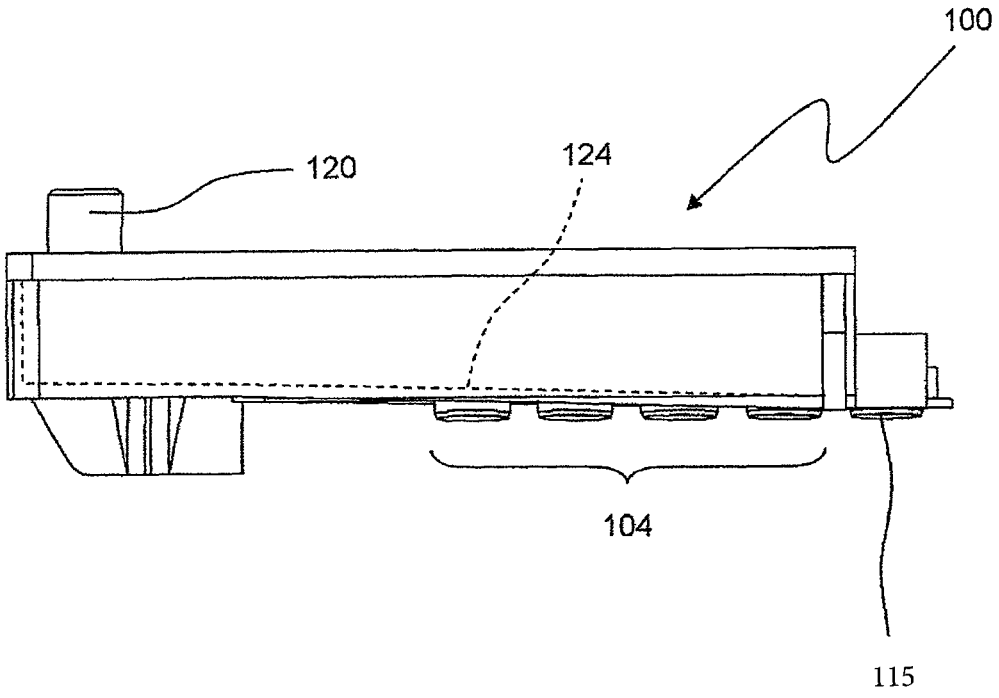
FIG. 16 is a front view of the exhaust duct.

FIG. 13 shows a top plan view of the exhaust duct 100 of the heating cooker, FIG. 14 shows a sectional view taken along a line XIV-XIV of FIG. 13, FIG. 15 shows a bottom view of the exhaust duct 100, and FIG. 16 shows a front view of the exhaust duct 100.

As shown in FIG. 13, the exhaust duct 100 has a merging part 100*a* on which an exhaust inlet 101 and the cooling air inlet 102 (shown in FIGS. 14, 15) are provided and a stirring discharge part 100*b* which extends rightward at a right angle from front face side (lower side in a page of FIG. 12) of the merging part 100*a*. A cylindrical connection part 120 having the exhaust inlet 101 is provided on top side of the merging part 100*a* of the exhaust duct 100 so as to stand thereon. A shield wall 103 having a section shaped like a letter U is provided in the exhaust duct 100 so as to surround a columnar region 106 which is defined by extending the connection part 120 into the exhaust duct 100. The shield wall 103 opens on the front face side (lower side in the page of FIG. 13) thereof.

The four discharge ports 104 are formed at specified intervals on bottom side of the stirring discharge part 100*b* of the exhaust duct 100.

The drain receiving part 111 to which the extremity part of the drain groove 110 is connected is provided on the rear face side (left side in a page of FIG. 14) of the merging part 100*a* of the exhaust duct 100. The cooling air inlet 102 is provided on the bottom side (left side in the page of FIG. 14) between the drain receiving part 111 and the exhaust inlet 101. Grooves 112, 113, and 114 are formed on a right side face of the merging part 100*a*, a rear face side and a right side face of the stirring discharge part 100*b*, respectively, on the exhaust duct 100, and a drain port 115 is formed in the groove 114. Water received by the drain receiving part 111 is guided to the drain port 115 by the grooves 112, 113, and 114, and is drained through the drain port 115 into the dew receiving container 4 on underside (dashed arrows in FIGS. 13 and 14 designate flow of the drainage). Drain guide grooves are composed of the grooves 112, 113, and 114.

In the merging part 100*a* of the exhaust duct 100, as shown in FIG. 14, an opening part 121 is provided between the cooling air inlet 102 and the connection part 120, and an inclined surface 122 that gradually lowers toward the stirring discharge part 100*b* is provided between the opening part 121 and the merging part 100*a*. In bottom part in the stirring discharge part 100*b* also, an inclined surface 124 (shown in FIG. 16) is provided that gradually lowers from a side of the merging part 100*a* toward a right end thereof. In event that the condensate water flows in through the exhaust inlet 101, the condensate water can be guided to the stirring discharge part 100*b* and can be drained through the four discharge ports 104 by the inclined surface 122 in the merging part 100*a* and the inclined surface 124 in the stirring discharge part 100*b*.

Under the opening part 121 between the cooling air inlet 102 and the connection part 120 of the exhaust duct 100, a partition wall 123 is provided of which top end is higher than bottom part immediately under the exhaust inlet 101 in the exhaust duct 100.

Position along height direction of the cooling air inlet 102 into which the cooling air flows from under the exhaust duct 100 is lower than position along the height direction of the discharge ports 104 of the exhaust duct 100, and the position along the height direction of the discharge ports 104 of the exhaust duct 100 is lower than position along the height direction of the exhaust inlet 101 of the exhaust duct 100. Difference in height between the cooling air inlet 102 and the discharge ports 104 is designated by H1, and difference in height between the discharge ports 104 and the exhaust inlet 101 is designated by H2.

The exhaust duct of the heating cooker of the invention is not limited to the exhaust duct 100 of the embodiment, and has only to have an exhaust inlet into which exhaust from the exhaust path flows, an air inflow port into which a portion of air from the fan flows from underside, and discharge ports through which mixture of the exhaust having flowed in through the exhaust inlet and the portion of the air from the fan having flowed in through the air inflow port is discharged to the outside, and position along the height direction of the air inflow port of the exhaust duct has only to be lower than position along the height direction of the discharge ports of the exhaust duct, and the position along the height direction of the air inflow port of the exhaust duct has only to be lower than position along the height direction of the exhaust inlet of the exhaust duct. Therefore, the position along the height direction of the exhaust inlet of the exhaust duct may be lower than the position along the height direction of the discharge ports of the exhaust duct, and the position along the height direction of the air inflow port has only to be the lowest of the positions of the air inflow port, the exhaust inlet, and the discharge ports of the exhaust duct.

The portion of the cooling air from the cooling fan 16 flows into the cooling air inlet 102 of the exhaust duct 100 from the underside in the embodiment, whereas a fan for discharge, a fan for dilution or the like may be used therefor without limitation to the cooling fan.

In the exhaust duct 100 shown in FIGS. 13 through 16, the exhaust flows from inside of the heating chamber 8 (shown in FIG. 6) through the exhaust tube 18 (shown in FIG. 6) and the exhaust inlet 101 into the merging part 100*a* of the exhaust duct 100, and the portion of the cooling air that flows through between the bottom face of the heating chamber 8 and the bottom plate 30 from the electric component chamber 9 (shown in FIG. 5) on the right side toward the left side where the exhaust duct 100 (shown in FIG. 8) exists flows through the cooling air inlet 102 into the merging part 100*a* of the exhaust duct 100. Then the cooling air and the exhaust flow to the stirring discharge part 100*b* while being mixed on downstream side (lower side in a page of FIG. 13) of the shield wall 103 in the merging part 100*a* of the exhaust duct 100, are stirred and diluted in the stirring discharge part 100*b*, and are thereafter discharged in form of mixed exhaust through the four discharge ports 104 into the dew receiving container 4 below.

Figure 17:
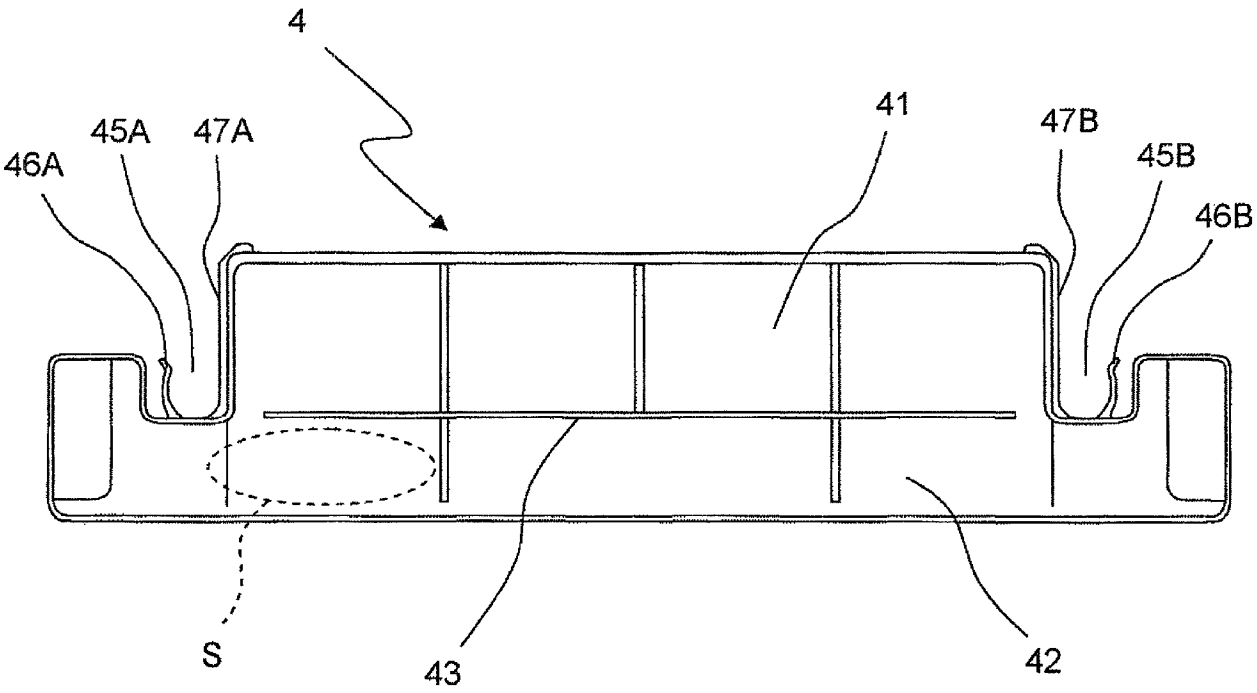
FIG. 17 is a top plan view of the dew receiving container of the heating cooker.
Figure 18:
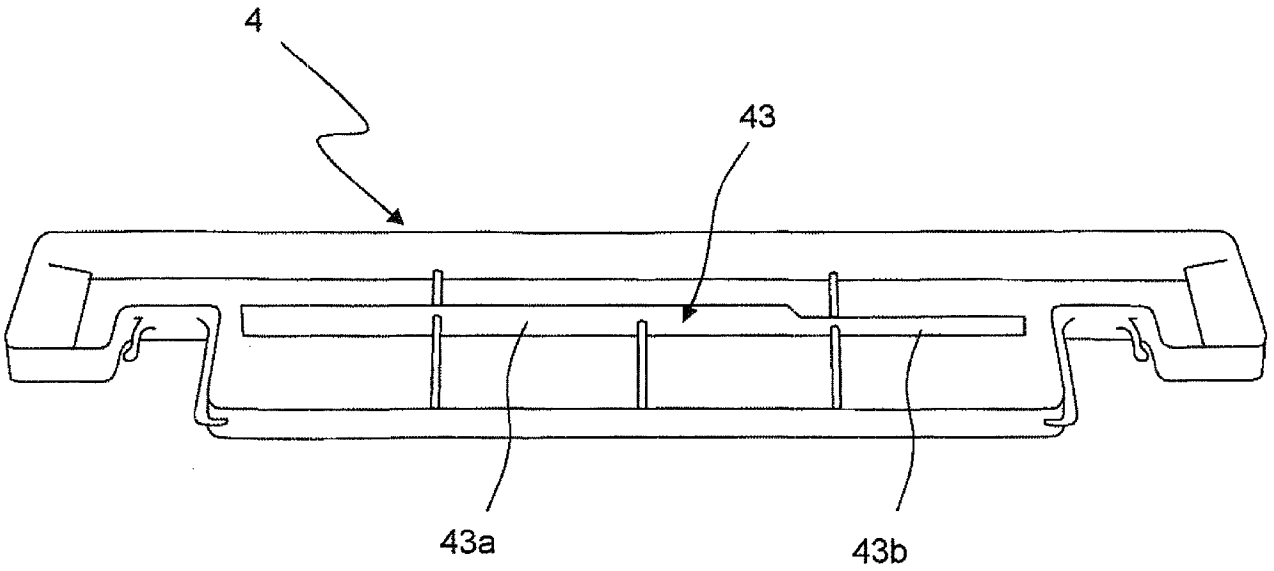
FIG. 18 is a perspective view of the dew receiving container, as seen looking from rear and diagonally upper side.

FIG. 17 shows a top plan view of the dew receiving container 4 of the heating cooker, and FIG. 18 shows a perspective view of the dew receiving container 4, as seen looking from rear and diagonally upper side.

As shown in FIGS. 17 and 18, the dew receiving container 4 has a first dew receiving recess 41 in shape of a laterally long rectangle and a second dew receiving recess 42 provided in front of the first dew receiving recess 41, and the first dew receiving recess 41 and the second dew receiving recess 42 are separated by a rib 43 as a cooling air guiding wall provided in the dew receiving container 4. The rib 43 includes a first rib 43*a* and a second rib 43*b* having a height smaller than the first rib 43*a* has. The first rib 43*a* occupies two-thirds in general on right side (left side in FIG. 18) of the rib 43.

The rib 43 is provided as the cooling air guiding wall in the dew receiving container 4 in the embodiment, whereas the cooling air guiding part is not limited thereto and the cooling air may be guided by separate members.

Fitting recesses 45A, 45B that open on the rear face side (upper side in FIG. 17) are provided at both ends of the first dew receiving recess 41 and curved arm parts 46A, 46B that extend toward the rear face side are provided in the fitting recesses 45A, 45B, respectively. Guide parts 47A, 47B are provided on sides facing the first dew receiving recess 41 in the fitting recesses 45A, 45B, respectively.

When the dew receiving container 4 is attached to the two front legs 6, 6 (shown in FIG. 1) provided on the front side on the bottom part of the casing 1, fitting protruding parts (not shown) of the front legs 6, 6 are fitted into the fitting recesses 45A, 45B while being guided by the guide parts 47A, 47B of the dew receiving container 4. Then the curved arm parts 46A, 46B of the dew receiving container 4 undergo elastic deformation and thereby cooperate with the guide parts 47A, 47B to nip the fitting protruding parts (not shown) of the front legs 6, 6, so that the dew receiving container 4 is held by the front legs 6, 6.

The region S (shown in FIG. 17) on left side in the second dew receiving recess 42 of the dew receiving container 4 faces openings of the discharge ports 104 of the exhaust duct 100 (shown in FIGS. 13 through 16) that reside thereover. The exhaust from the discharge ports 104 of the exhaust duct 100 is received by the region S in the second dew receiving recess 42 in the dew receiving container 4 that resides thereunder and is diffused to the outside of the casing 1. Then the exhaust diffuses from inside of the second dew receiving recess 42 in the dew receiving container 4 through a gap between the dew receiving container 4 and the door 2 with handle, a gap between the dew receiving container 4 and the casing 1 and/or the like into vast outside space on the front face side of the casing 1.

Waterdrops dropping from the drain port 115 of the exhaust duct 100 are received by the second dew receiving recess 42 in the dew receiving container 4.

The cooling air blown off through the cooling air blow-off ports 70 provided on the bottom part and front face side of the casing 1 is guided toward the region S in the dew receiving container 4 by the rib 43 as the cooling air guiding wall.

In the heating cooker having above configuration, the water supply tank containing a required quantity of water is housed in the tank housing part 15, and cooking with use of steam is thereafter started by an operation on the operation panel 3. Then the heaters 26 provided on the upper side in the heating chamber 8 are turned on, the water supply pump is activated so as to supply water in the water supply tank into the steam producing device 13, and steam is produced by heating of the water supplied into the steam producing device 13 by the steam producing heater 24. The steam produced by the steam producing device 13 blows into the heating chamber 8, and becomes superheated steam having a temperature of 100° C. or higher by being heated in the heating chamber 8 by the heaters 26. Thus food in the heating chamber 8 is cooked by radiant heat from the heaters 26 on the upper side in the heating chamber 8 and the superheated steam having the temperature of 100° C. or higher. Then the superheated steam supplied to and deposited on surfaces of the food condenses on the surfaces of the food and gives the food a great quantity of latent heat of condensation, and therefore heat can efficiently be transmitted to the food.

In the heating cooker, oven cooking may be performed with use of only the heaters 26 (shown in FIGS. 4 and 5) and without use of steam or steam cooking or the like may be performed with use of only steam produced by the steam producing device 13 and without use of the heaters 26.

Figure 19:
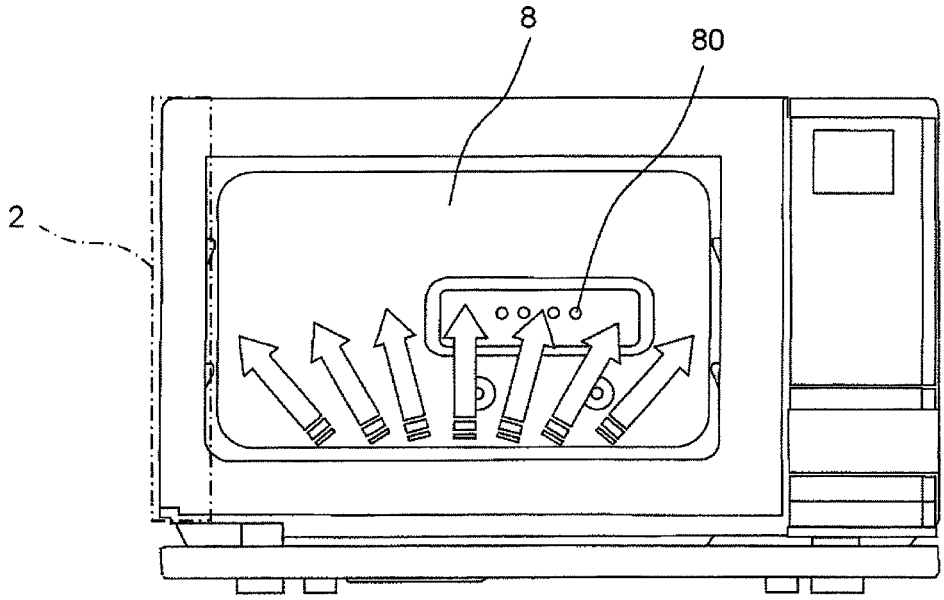
FIG. 19 is a front view of the heating cooker with the door with handle opened in cooking with use of microwaves.

FIG. 19 shows a front view of the heating cooker, with the door 2 with handle opened, in cooking with use of microwaves. In the cooking with use of microwaves, an object to be heated is placed on the bottom part of the heating chamber 8. In FIG. 19, numeral 80 denotes the steam blow-off ports through which steam is blown from the steam producing device 13 (shown in FIG. 5) into the heating chamber 8.

Figure 20:
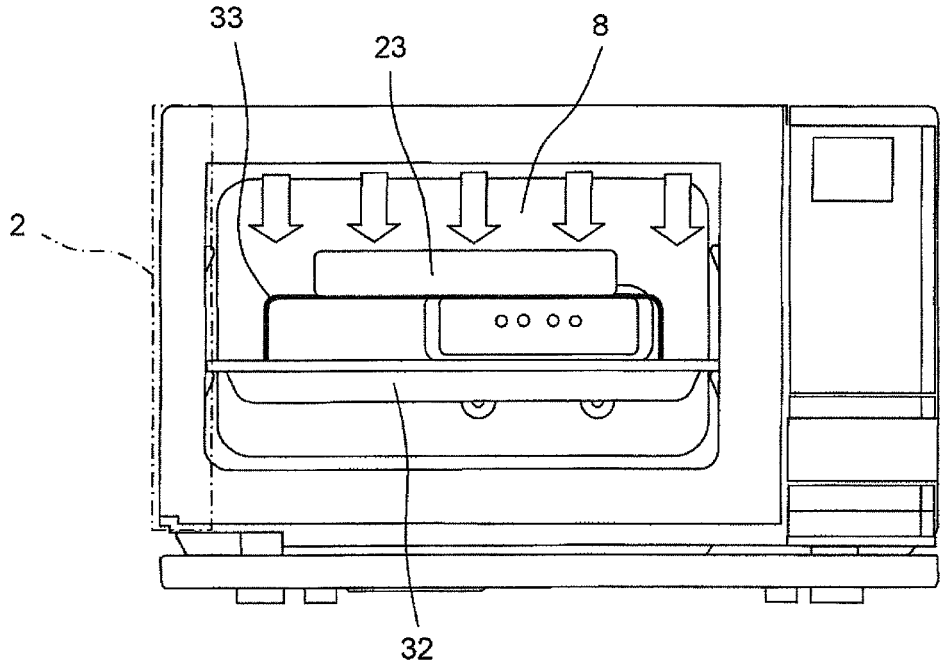
FIG. 20 is a front view of the heating cooker in cooking of a small piece of food by heaters.

FIG. 20 shows a front view of the heating cooker in cooking of a small piece of food by the heaters 26. In the cooking by the heaters 26 (shown in FIGS. 4, 5), a tray 32 having a grill 33 placed thereon is inserted into a lower level in the heating chamber 8, and the object 23 to be heated is placed on the grill 33. Thus the object 23 to be heated is heated by the heaters 26 placed on the upper side in the heating chamber 8.

Figure 21:
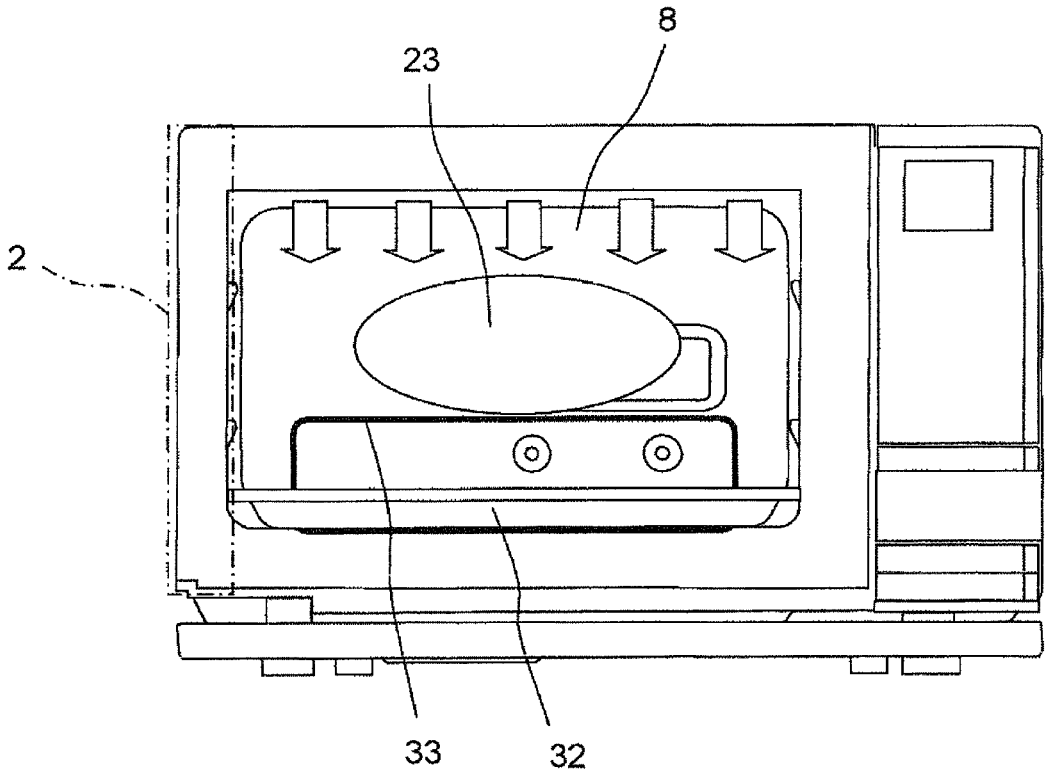
FIG. 21 is a front view of the heating cooker in cooking of a large piece of food by the heaters.

FIG. 21 shows a front view of the heating cooker in cooking of a large piece of food by the heaters 26. In the cooking by the heaters 26 (shown in FIGS. 4, 5), the tray 32 having the grill 33 placed thereon is placed on the bottom part in the heating chamber 8, and the object 23 to be heated is placed on the grill 33. Thus the object 23 to be heated is heated by the heaters 26 placed on the upper side in the heating chamber 8.

Figure 22:
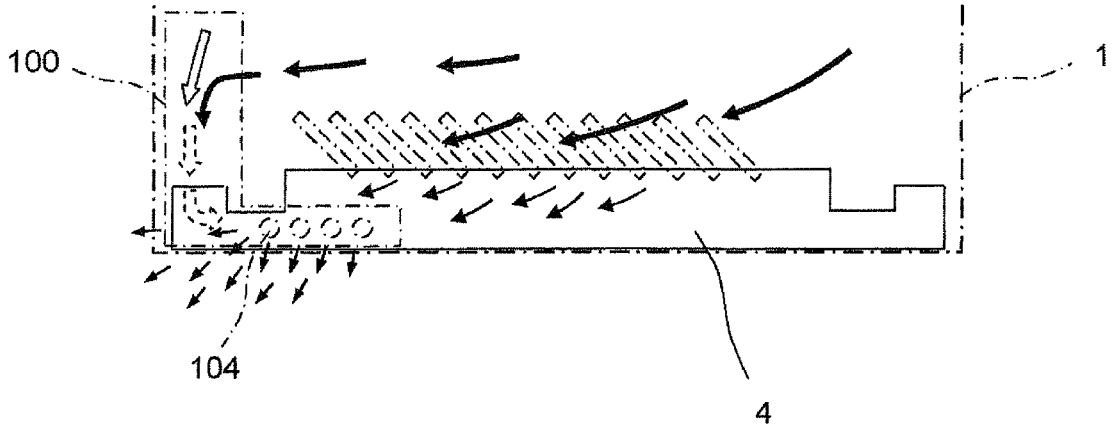
FIG. 22 is a schematic representation for illustrating air flow on front face side and lower side in the heating cooker.

FIG. 22 shows a schematic view for illustrating air flow on the front face side and the lower side of the heating cooker. FIG. 22 is the schematic view as seen looking from above, black arrows denoting the cooling air flowing through between the bottom face of the heating chamber 8 and the bottom plate 30 from the electric component chamber 9 (shown in FIG. 5) on the right side toward the left side where the exhaust duct 100 (shown in FIG. 8) exists, a white arrow defined by solid lines denoting the exhaust from the inside of the heating chamber 8, white arrows defined by dashed lines denoting mixed air. The drain port 115 is omitted in FIG. 22.

As shown in FIG. 22, the exhaust flows from the inside of the heating chamber 8 (shown in FIG. 6) through the exhaust inlet 101 (shown in FIG. 13) of the exhaust duct 100 into the exhaust duct 100, and the portion of the cooling air that flows through between the bottom face of the heating chamber 8 and the bottom plate 30 from the electric component chamber 9 (shown in FIG. 5) on the right side toward the left side where the exhaust duct 100 (shown in FIG. 8) exists flows through the cooling air inlet 102 (shown in FIG. 13) of the exhaust duct 100 into the exhaust duct 100. The cooling air and the exhaust are mixed in the exhaust duct 100 and are thereafter discharged through the four discharge ports 104 toward the dew receiving container 4 below.

When the heating chamber 8 is increased in temperature and is filled with steam, smoke and/or the like produced from heated food in the cooking of the food put in the heating chamber 8, in the heating cooker having the above configuration, the exhaust from the inside of the heating chamber 8 is guided by the exhaust tube 18 and the exhaust duct 100 through the inside of the casing 1 to the front face side. The exhaust from the discharge ports 104 of the exhaust duct 100 is received and is diffused to the outside of the casing 1 by the dew receiving container 4 provided on the front face side of the casing 1. Then the highly heated exhaust containing steam from the inside of the heating chamber 8 is cooled by being mixed with the cooling air in the exhaust duct 100, so that the cooled exhaust having a decreased temperature can be received by the dew receiving container 4 on the front face side and can be diffused to the vast outside space on the front face side of the casing 1.

Even if there are wall surfaces in vicinity of the rear face side of the heating cooker main body, shelves just thereover, and/or the like, corrosion, dense growth of mold and/or the like are thereby prevented that might be caused on the wall surfaces, the shelves and/or the like by contact therewith of the highly heated exhaust containing steam, because the exhaust in the chamber is not discharged from the rear face side of the main body. Under condition of the placement in a narrow space, accordingly, the exhaust from the inside of the heating chamber 8 can be processed without being discharged from the rear face side.

Means for cooking the object to be heated in the heating chamber 8 is not limited to heating by the heaters and may be cooking including steam cooking with use of steam and the like or may be cooking with use of superheated steam having a temperature of 100° C. or higher.

As shown in FIG. 14, the position along the height direction of the cooling air inlet 102 into which the cooling air flows from under the exhaust duct 100 is lower than the position along the height direction of the discharge ports 104 of the exhaust duct 100, and the position along the height direction of the cooling air inlet 102 of the exhaust duct 100 is lower than the position along the height direction of the exhaust inlet 101 of the exhaust duct 100, so that the exhaust that flows through the exhaust inlet 101 of the exhaust duct 100 into the exhaust duct 100 when the fan is stopped due to breakdown thereof or the like is prevented from flowing out through the cooling air inlet 102 that is in the lowest position because the exhaust is initially and gradually accumulated from upside in the exhaust duct 100 and is thereafter discharged to the outside through the discharge ports 104 that are in the higher position along the height direction than the cooling air inlet 102. Therefore, the exhaust from the inside of the heating chamber 8 can be prevented from flowing into the main body even if the cooling fan 16 for supplying the cooling air that is to be mixed with the exhaust breaks down. Thus the steam can be prevented from entering the electric component chamber 9.

With the provision of the exhaust inlet 101 in an air path between the cooling air inlet 102 and the discharge ports 104 in the exhaust duct 100 and the provision of the shield wall 103 between the cooling air inlet 102 and the exhaust inlet 101, flow of the exhaust that has flowed in from the heating chamber 8 through the exhaust tube 18 and the exhaust inlet 101 can be prevented from being disturbed by the cooling air from the cooling air inlet 102 and from being reversed toward the exhaust inlet 101.

With use of the shield wall 103 that has the section shaped like a letter U so as to surround a side for the cooling air inlet 102, of the columnar region 106 extended from the exhaust inlet 101 into the exhaust duct 100 and so as to open on a side of the columnar region 106 for the discharge ports 104, the exhaust from the exhaust inlet 101 can be drawn into the exhaust duct 100 by ejector effect owing to difference in flow velocity between flow of the cooling air from the cooling air inlet 102 and the exhaust from the exhaust inlet 101 because the shield wall 103 opens on the side for the discharge ports 104 in the air path from the cooling air inlet 102 to the discharge ports 104. Thus the exhaust flowing in through the exhaust inlet 101 can smoothly be merged with the cooling air from the cooling air inlet 102.

Even if quantity of the exhaust is sharply increased according to type of the object 23 to be heated in the heating chamber 8 and/or the like, the four discharge ports 104 of the exhaust duct 100 prevent discharge of highly heated exhaust because the exhaust is dispersively discharged to the outside through the plurality of discharge ports 104. The number of the discharge ports of the exhaust duct is not limited thereto and may be two, three, or five or more.

Even if the condensate water produced in the exhaust tube 18 and/or the like drops from the exhaust inlet 101 of the exhaust duct 100 when the exhaust from the inside of the heating chamber 8 flows through the exhaust tube 18 into the exhaust duct 100, placement of the cooling air inlet 102 in a region except a region immediately under the exhaust inlet 101 of the exhaust duct 100 prevents leakage of the water through the cooling air inlet 102 that is lower in position along the height direction than the exhaust inlet 101 because the cooling air inlet 102 is not immediately under the exhaust inlet 101.

With a bend of the exhaust duct 100 between the cooling air inlet 102 and the discharge ports 104 of the exhaust duct 100 and on a side nearer to the discharge ports 104 than to the exhaust inlet 101, the exhaust that has flowed into the exhaust duct 100 through the exhaust inlet 101 is mixed with the portion of the cooling air from the cooling fan 16 that has flowed in through the cooling air inlet 102 in the air path between the cooling air inlet 102 and the discharge ports 104, and the mixed exhaust is thereafter guided through the bent air path to the discharge ports 104, so that efficient mixture of the exhaust and the cooling air results in uniform temperature of the mixed exhaust that is discharged to the outside through the discharge ports 104 and prevents discharge of highly heated exhaust with biased temperature distribution.

Even if the condensate water produced in the exhaust tube 18 and/or the like drops from the exhaust inlet 101 of the exhaust duct 100 when the exhaust from the inside of the heating chamber 8 flows through the exhaust tube 18 into the exhaust duct 100, bottom part of the exhaust duct 100 having the inclined surface 122 that gradually lowers from the side of the exhaust inlet 101 toward the side of the discharge ports 104 causes the condensate water to flow from the side of the exhaust inlet 101 toward the side of the discharge ports 104 along the inclined surface 122 on the bottom part of the exhaust duct 100 and to be discharged to the outside through the discharge ports 104 and prevents the condensate water from being accumulated in the exhaust duct 100.

Even if the condensate water produced in the exhaust tube 18 and/or the like drops from the exhaust inlet 101 of the exhaust duct 100 when the exhaust from the inside of the heating chamber 8 flows through the exhaust tube 18 into the exhaust duct 100, the partition wall 123 of which the top end is higher than the bottom part immediately under the exhaust inlet 101 in the exhaust duct 100 and which is provided in the air path between the cooling air inlet 102 and the exhaust inlet 101 in the exhaust duct 100 prevents the condensate water from flowing toward the cooling air inlet 102 that is lower in position along the height direction than the exhaust inlet 101.

With use of the exhaust duct 100 having the drain guide grooves (groove 112, groove 113, and groove 114) that are provided on outside of side walls of the exhaust duct 100 and that guide drain from the side of the exhaust inlet 101 toward the side of the discharge ports 104 and having the drain port 115 that is provided on a side in the drain guide grooves closer to the discharge ports 104, the condensate water produced in the casing 1 is gathered by the drain receiving part 111, and the gathered drain is thereafter guided toward the drain port 15 by the drain guide grooves of the exhaust duct 100 and is discharged through the drain port 115 to the outside. By the condensate water flowing in the drain guide grooves on the side walls of the exhaust duct 100, in this manner, the exhaust duct 100 can be cooled, the temperature of the mixed exhaust in the exhaust duct 100 can be decreased, and effect of cooling the exhaust can be improved. In addition, the one exhaust duct 100 is capable of combining exhaust disposal function and drain disposal function.

The mixed exhaust from the discharge ports 104 of the exhaust duct 100 is received and is diffused to the outside of the casing 1 by the dew receiving container 4 that is placed under the opening of the heating chamber 8, and thus the cooled exhaust having a decreased temperature can be received by the dew receiving container 4 on the front face side and can be diffused to the vast outside space on the front face side of the casing 1.

The portion of the cooling air from the cooling fan 16 for cooling at least the electric components in the casing 1 is blown off through the cooling air blow-off ports 70 provided on the bottom part and the front face side of the casing 1 toward the region in the dew receiving container 4 that receives and diffuses the exhaust from the discharge ports 104 of the exhaust duct 100, and the exhaust blown off from the discharge ports 104 of the exhaust duct 100 into the dew receiving container 4 is thereby diluted with the portion of the cooling air while the diffusion thereof is promoted, so that the exhaust can efficiently be diffused to the vast outside space on the front face side of the casing 1.

The cooling air blown off through the cooling air blow-off ports 70 provided on the bottom part and the front face side of the casing 1 is guided toward the region S in the dew receiving container 4 that receives and diffuses the exhaust from the discharge ports 104 of the exhaust duct 100, by the cut and raised parts 70*b* (the cooling air guiding parts) provided in the cooling air blow-off ports 70, and thus the exhaust blown off from the discharge ports 104 of the exhaust duct 100 into the dew receiving container 4 can efficiently be diluted and diffused.

With the exhaust diluted and diffused by the cooling air blown off through the cooling air blow-off ports 70 provided on the bottom part and the front face side of the casing 1, the dew receiving container 4 receives the exhaust from the discharge ports 104 of the exhaust duct 100, on the side at left side end of the casing 1 where a center of pivoting of the door 2 with handle exists, and thus a hand that grasps the door 2 with handle being opened is opposed to the center of pivoting of the door 2 with handle, so that the hand that grasps the door 2 with handle is prevented from being exposed to the exhaust diffused by the dew receiving container 4.

The cooling air blown off through the cooling air blow-off ports 70 provided on the bottom part and the front face side of the casing 1 is guided toward the region S in the dew receiving container 4 that receives and diffuses the exhaust from the discharge ports 104 of the exhaust duct 100, by the rib 43 (cooling air guiding wall) that is provided in the dew receiving container 4, and thus the exhaust blown off from the discharge ports 104 of the exhaust duct 100 into the dew receiving container 4 can efficiently be diluted and diffused.

The exhaust from the inside of the heating chamber 8 is mixed with the other portion of the cooling air from the cooling fan 16 and is discharged into the dew receiving container 4 by the exhaust duct 100 provided on the side of the discharge ports 104 of the exhaust duct 100 in the casing 1, and thus the dilution of the exhaust and the decrease in the temperature of the exhaust can efficiently be attained with the utilization of the cooling air from the cooling fan 16 for cooling the electric components.

The exhaust tube 18 that is the exhaust path may be extended through the electric component chamber 9 (cooling space) in the casing 1 so as to guide the exhaust from the inside of the heating chamber 8 to the front face side. Thus path length of the exhaust path can be increased, and cooling efficiency can be increased by the extension of the path running through the electric component chamber 9 (cooling space).

The heating cooker using the dew receiving container 4 that diffuses the mixed exhaust from the discharge ports of the exhaust duct has been described for the embodiment, whereas form of the dew receiving container is not limited thereto and the dew receiving container has only to receive the exhaust from the discharge ports of the exhaust duct and to diffuse the exhaust to the outside of the casing.

Though the opening 8*a* of the heating chamber 8 is opened and closed by the door 2 with handle that pivots in transversal directions with respect to the casing 1 in the embodiment, whereas a door which the heating cooker of the invention includes may be of sliding type or turning type.

Heating cookers according to the invention includes not only microwave ovens using superheated steam but also ovens using superheated steam, microwave ovens not using superheated steam, ovens not using superheated steam, and the like, for instance.

In the heating cookers of the invention, healthy cooking can be performed by use of superheated steam or saturated steam in microwave ovens and the like. In the heating cookers of the invention, for instance, superheated steam or saturated steam having a temperature of 100° C. or higher is supplied onto surfaces of food, the superheated steam or saturated steam deposited onto the surfaces of the food condenses and gives the food a great quantity of latent heat of condensation, and therefore heat can efficiently be transmitted to the food. The condensate water is deposited on the surfaces of the food, and salt content, oil content and the like drop with the condensate water, so that salt content, oil content and the like in the food can be reduced. Furthermore, the heating chamber is filled with the superheated steam or saturated steam so as to be poor in oxygen, and thus cooking in which oxidation of the food is suppressed can be performed. Herein, a condition poor in oxygen refers to a condition in which volume percentage of oxygen is 10% or lower (e.g., between 0.5 and 3%) in the heating chamber.

Though the specific embodiment of the invention has been described, the invention is not limited to the embodiment described above and can be embodied with modification in various ways within the scope of the invention.

REFERENCE SIGNS LIST

1 casing
2 door with handle
3 operation panel
4 dew receiving container
6, 6 front leg
7 liquid crystal display part
8 heating chamber
8*a* opening
8*c* exhaust port
8*b* air supply port

9 electric component chamber
10 air intake space
11, 11 heat shield plate
13 steam producing device
15 tank housing part
16 cooling fan
17 air intake
18 exhaust tube
21 partition wall
23 object to be heated
24 steam producing heater
26 heater
30 bottom plate
32 tray
33 grill
43 rib
51 magnetron
70 cooling air blow-off port
70*a* slit part
70*b* cut and raised part
100 exhaust duct
100*a* merging part
100*b* stirring discharge part
101 exhaust inlet
102 cooling air inlet
103 shield wall
104 discharge port
105 drain port
110 drain groove
111 drain receiving part
112, 113, 114 groove
115 drain port
120 connection part
121 opening part
122 inclined surface
123 partition wall
124 inclined surface

The invention claimed is:

1. A heating cooker comprising:

a casing, a heating chamber that is provided in the casing and that has an opening on a front face of the heating chamber, an exhaust path for guiding exhaust from inside of the heating chamber to front face side of the casing, a fan that is provided in the casing, and an exhaust duct having an exhaust inlet into which the exhaust from the exhaust path flows, an air inflow port in fluid communication with the exhaust inlet and into which a portion of air from the fan flows from underside of the heating chamber, and at least one discharge port through which mixture of the exhaust having flowed in through the exhaust inlet and the portion of the air from the fan having flowed in through the air inflow port is discharged to outside from a bottom face of the casing at a position adjacent to the front face side of the casing, wherein position along height direction of the air inflow port of the exhaust duct is lower than position along the height direction of the discharge port of the exhaust duct, and wherein the position along the height direction of the air inflow port of the exhaust duct is lower than position along the height direction of the exhaust inlet of the exhaust duct, and wherein the position along the height direction of the exhaust inlet of the exhaust duct is higher than position along the height direction of the at least one discharge port.

2. The heating cooker as claimed in claim 1, wherein the exhaust inlet is provided in an air path between the air inflow port and the discharge port in the exhaust duct, and wherein a shield wall is provided between the air inflow port and the exhaust inlet in the exhaust duct.

3. The heating cooker as claimed in claim 2, wherein the shield wall is a wall that has a section shaped like a letter U so as to surround a side for the air inflow port, of a columnar region extended from the exhaust inlet into the exhaust duct and so as to open on a side of the columnar region for the discharge port.

4. The heating cooker as claimed in claim 1, wherein the exhaust duct comprises a plurality of the discharge ports.

5. The heating cooker as claimed in claim 1, wherein the air inflow port is placed in a region except a region immediately under the exhaust inlet in the exhaust duct.

6. The heating cooker as claimed in claim 1, wherein the exhaust duct is bent between the air inflow port and the discharge ports and on a position that is nearer to the discharge ports than to the exhaust inlet.

7. The heating cooker as claimed in claim 1, wherein bottom part in the exhaust duct has an inclined surface that gradually lowers from side of the exhaust inlet toward side of the discharge ports.

8. The heating cooker as claimed in claim 1, wherein a partition wall of which top end is higher than the bottom part immediately under the exhaust inlet in the exhaust duct is provided in an air path between the air inflow port and the exhaust inlet in the exhaust duct.

9. A heating cooker comprising:

a casing, a heating chamber that is provided in the casing and that has an opening on a front face of the heating chamber, an exhaust path for guiding exhaust from inside of the heating chamber to front face side of the casing, a fan that is provided in the casing, and an exhaust duct having an exhaust inlet into which the exhaust from the exhaust path flows, an air inflow port in fluid communication with the exhaust inlet and into which a portion of air from the fan flows from underside of the heating chamber, and at least one discharge port through which mixture of the exhaust having flowed in through the exhaust inlet and the portion of the air from the fan having flowed in through the air inflow port is discharged to outside, wherein position along height direction of the air inflow port of the exhaust duct is lower than position along the height direction of the discharge port of the exhaust duct, and wherein the position along the height direction of the air inflow port of the exhaust duct is lower than position along the height direction of the exhaust inlet of the exhaust duct, and wherein the position along the height direction of the exhaust inlet of the exhaust duct is higher than position along the height direction of the at least one discharge port, wherein the exhaust duct comprises drain guide grooves that are provided on outside of side walls of the exhaust duct and that guide drain from the side of the exhaust inlet toward the side of the discharge ports and a drain port that is provided on a side nearer to the discharge ports than to the exhaust inlet in the drain guide grooves.

10. The heating cooker as claimed in claim 1, further comprising:

a dew receiving container that is placed under the opening of the heating chamber, that receives the exhaust from the discharge ports of the exhaust duct, and that diffuses the exhaust to outside of the casing.

* * * * *